US009880494B2

(12) United States Patent
Mimura

(10) Patent No.: US 9,880,494 B2
(45) Date of Patent: Jan. 30, 2018

(54) TONER CONTAINER, IMAGE FORMING APPARATUS

(71) Applicant: KYOCERA Document Solutions Inc., Osaka-shi, Osaka (JP)

(72) Inventor: Daisuke Mimura, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/393,043

(22) Filed: Dec. 28, 2016

(65) Prior Publication Data

US 2017/0357182 A1 Dec. 14, 2017

(30) Foreign Application Priority Data

Jun. 8, 2016 (JP) ..... 2016-114516

(51) Int. Cl.
*G03G 15/08* (2006.01)

(52) U.S. Cl.
CPC ..... *G03G 15/0877* (2013.01)

(58) Field of Classification Search
CPC ..... G03G 15/0875; G03G 15/0891; G03G 15/095; G03G 21/105; G03G 2215/068; G03G 2221/1621; G03G 2221/0005
See application file for complete search history.

(56) References Cited

U.S. PATENT DOCUMENTS 5,109,254 A * 4/1992 Oka ..... G03G 15/0844 222/108
2008/0170887 A1 7/2008 Nishimura et al.
2011/0236075 A1* 9/2011 Suzuki ..... G03G 15/0877 399/262
2011/0262189 A1* 10/2011 Saito ..... G03G 15/0875 399/258
2012/0076548 A1* 3/2012 Ninomiya ..... G03G 15/0875 399/262
2017/0003627 A1* 1/2017 Inada ..... G03G 15/161

FOREIGN PATENT DOCUMENTS

JP 2008170897 A 7/2008

* cited by examiner

*Primary Examiner* — Francis Gray
(74) *Attorney, Agent, or Firm* — Alleman Hall Creasman & Tuttle LLP

(57) ABSTRACT

A toner container includes an elongated container main body, a toner discharge port, a first rotation member configured to convey the toner toward the toner discharge port, a support plate provided in the container main body and disposed in such a way as to face the wall surface, and an opening and closing member provided between the wall surface and the support plate and supported by the support plate in such a way as to be able to move between a closing position and an opening position. The support plate includes a first opening portion formed at a position corresponding to the toner discharge port and larger than the toner discharge port in size, and a film member attached to the support plate in such a way as to cover the first opening portion and including a second opening portion formed at a position corresponding to the toner discharge port.

4 Claims, 15 Drawing Sheets

【FIG. 1】
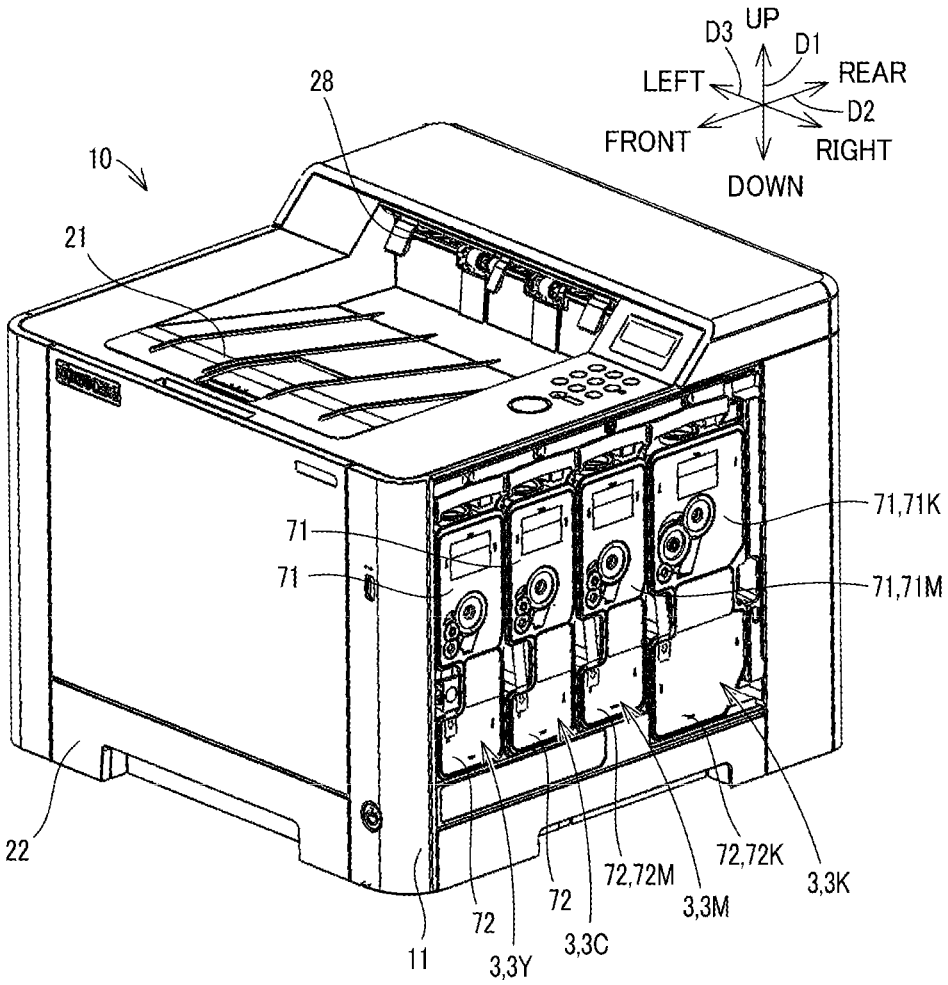

【FIG. 2】
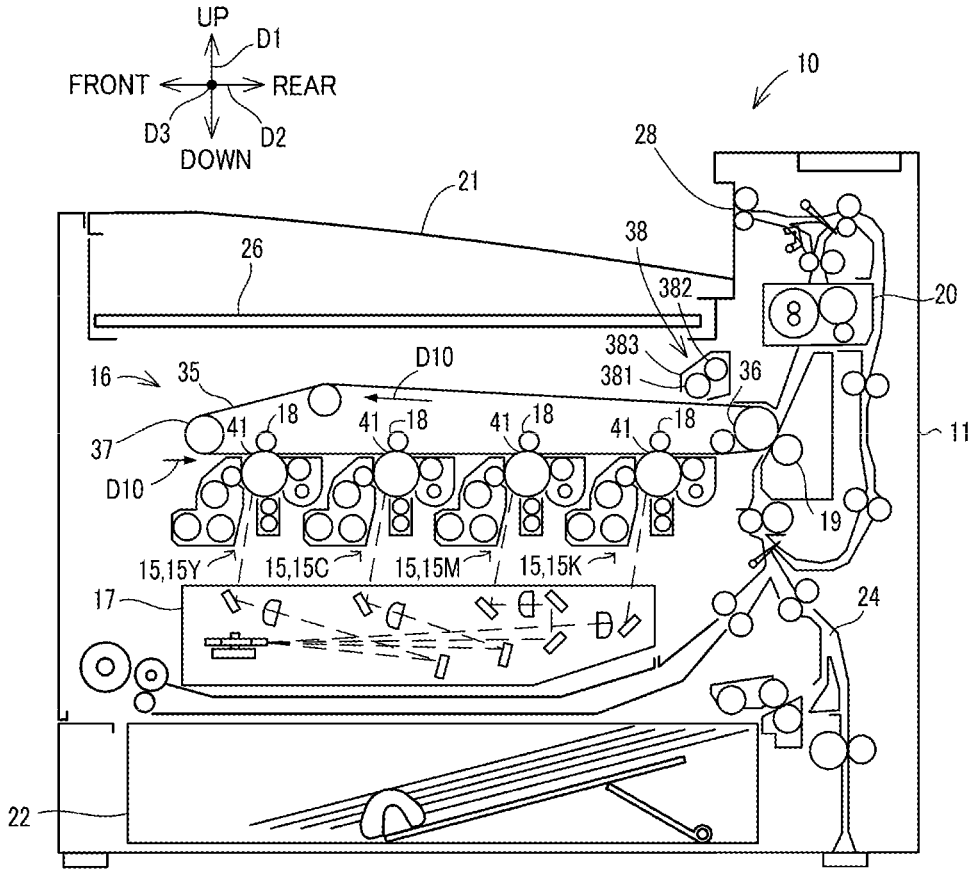

【FIG. 3】
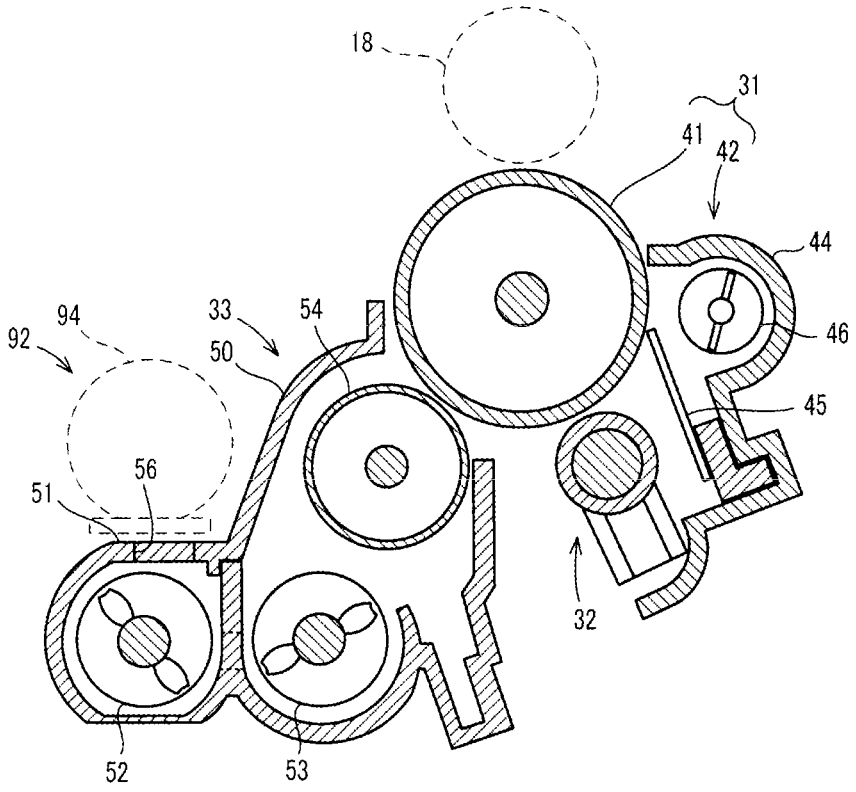

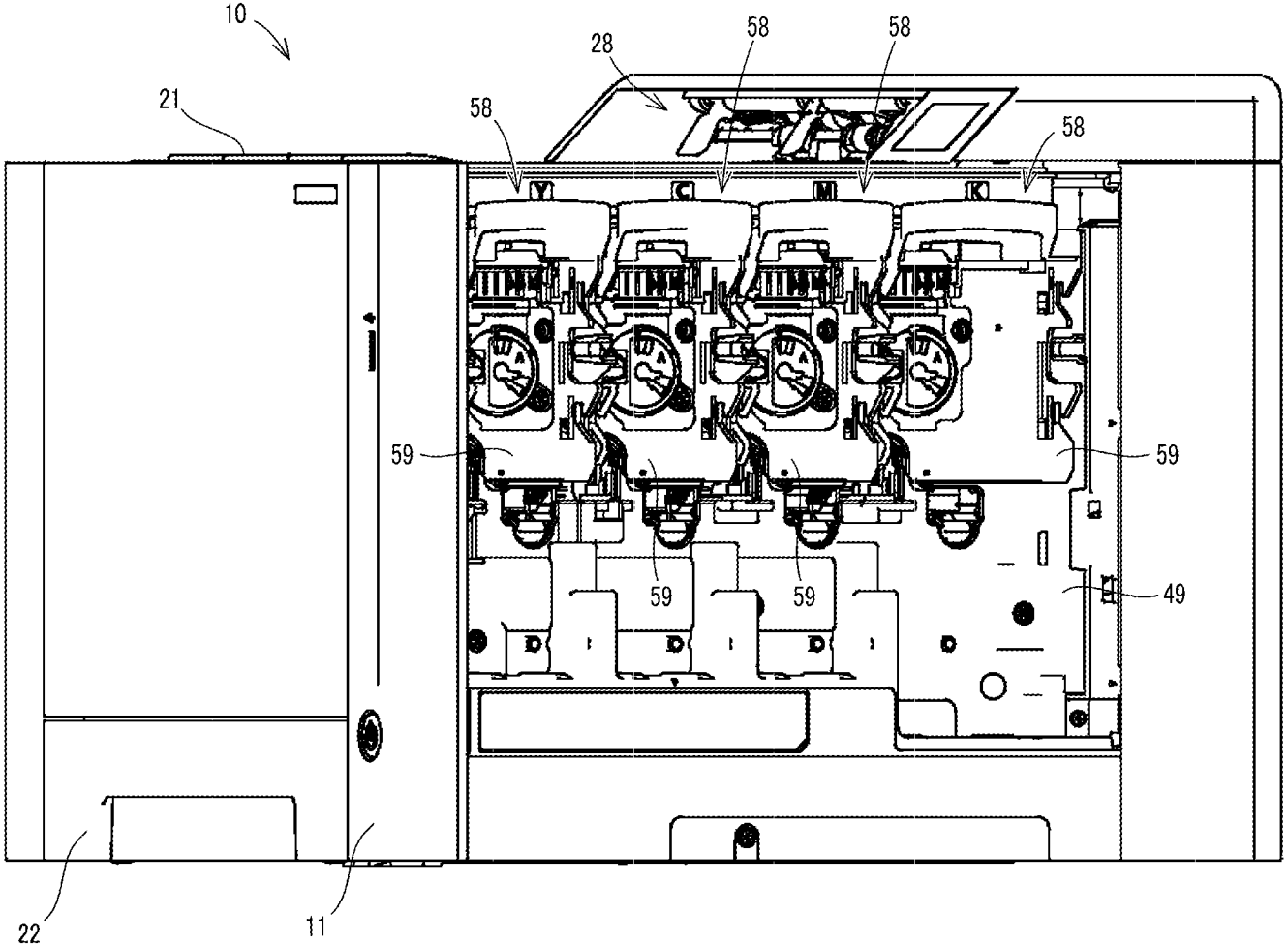
【FIG. 4】

【FIG. 5】
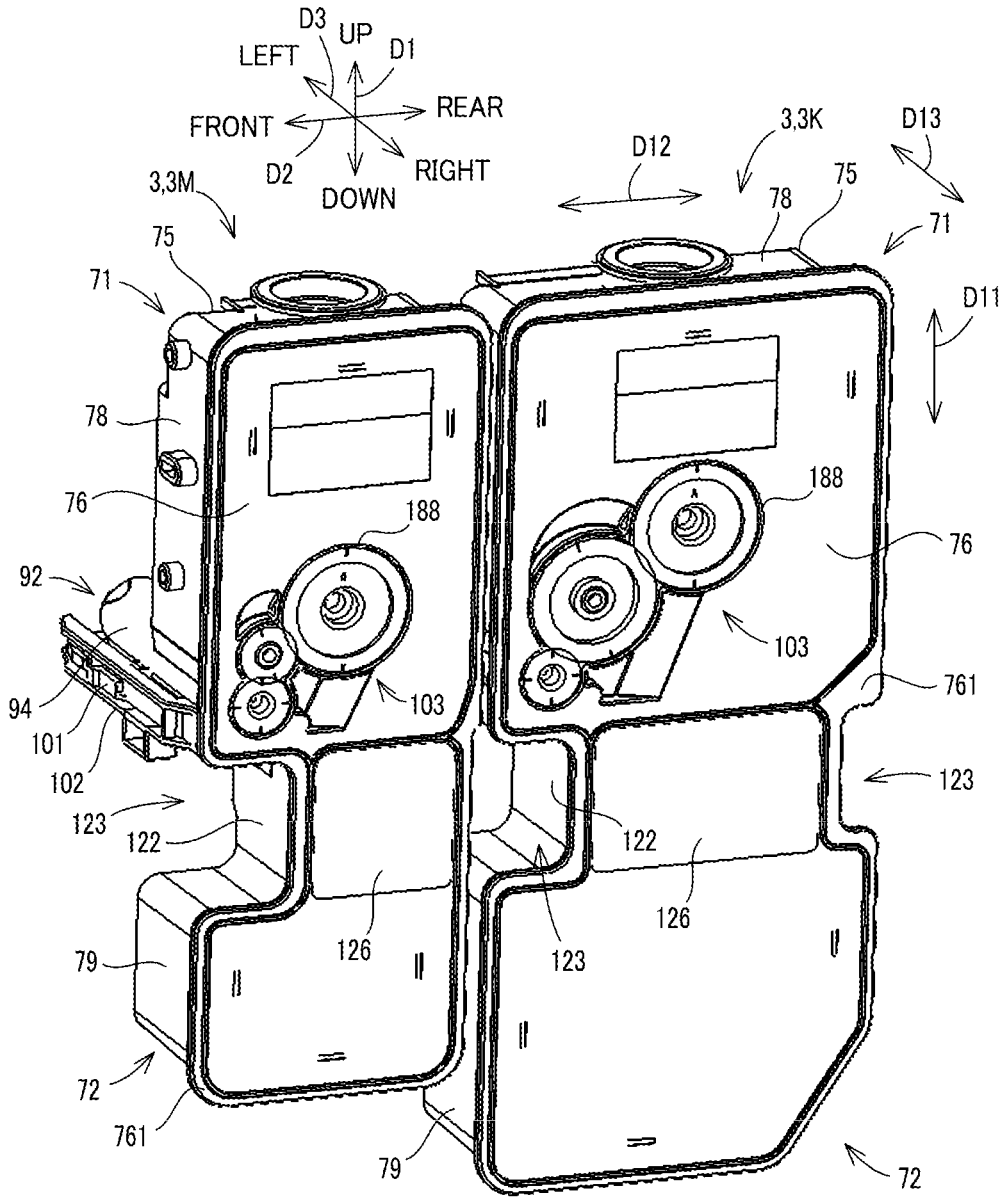

【FIG. 6】
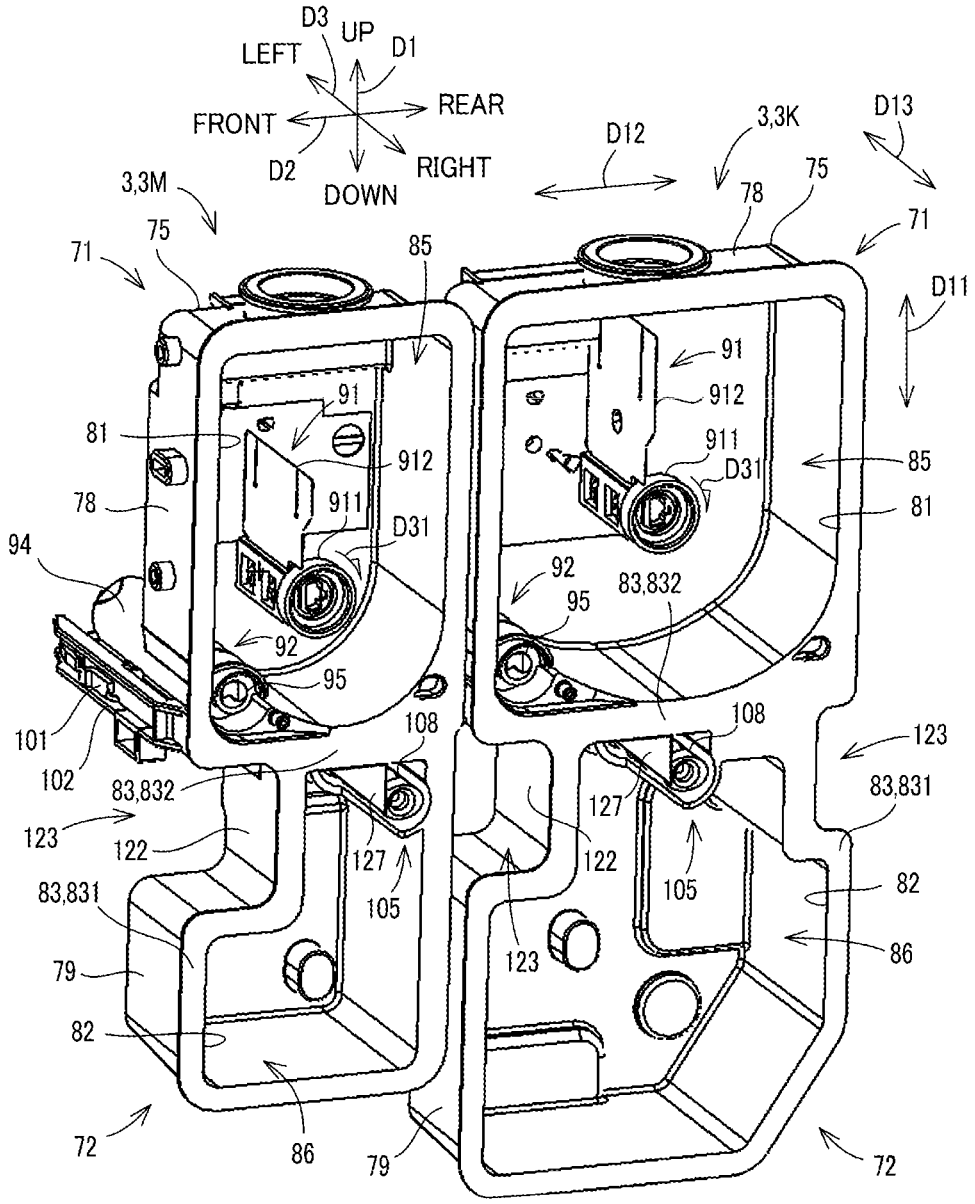

【FIG. 7】
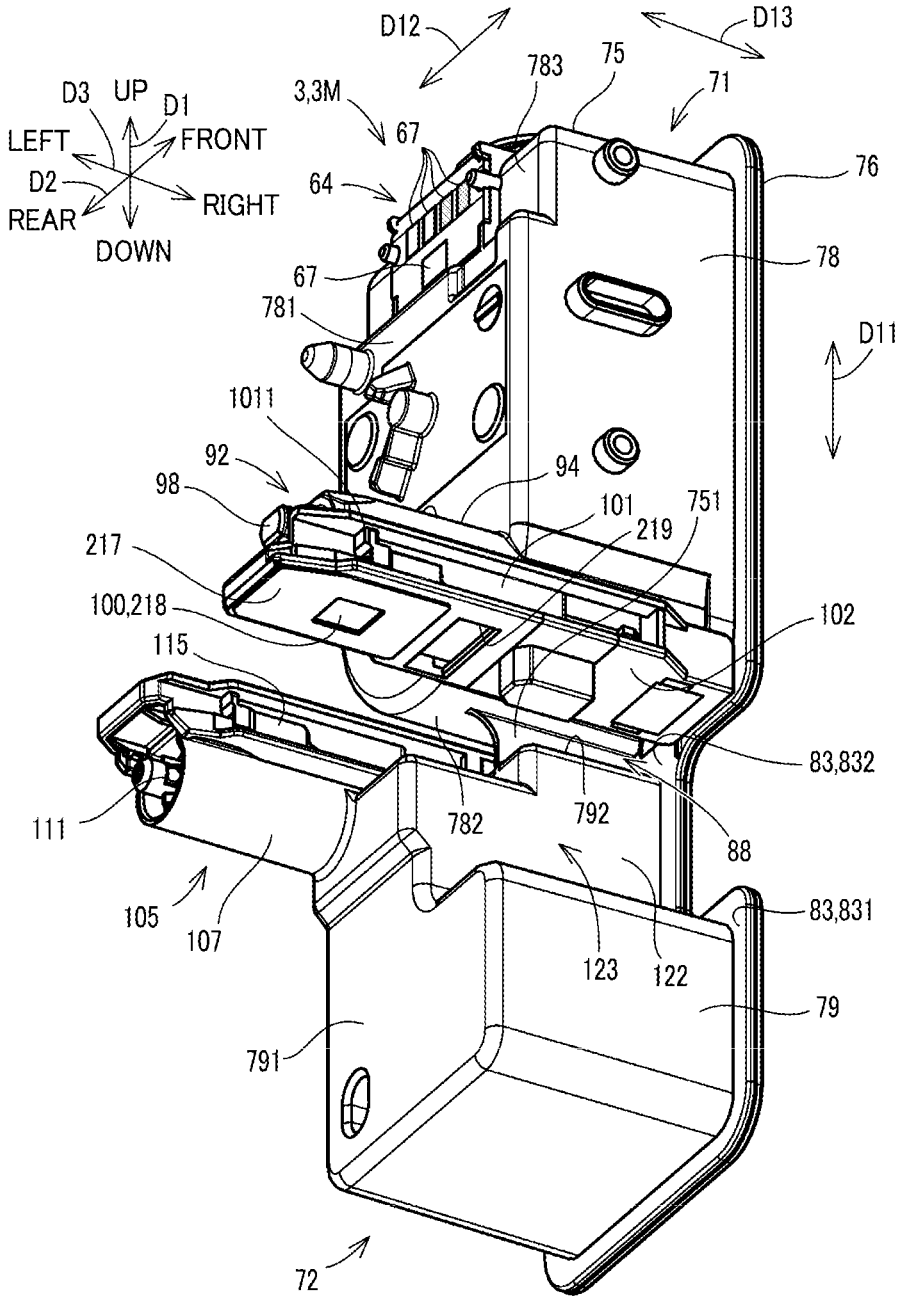

【FIG. 8】
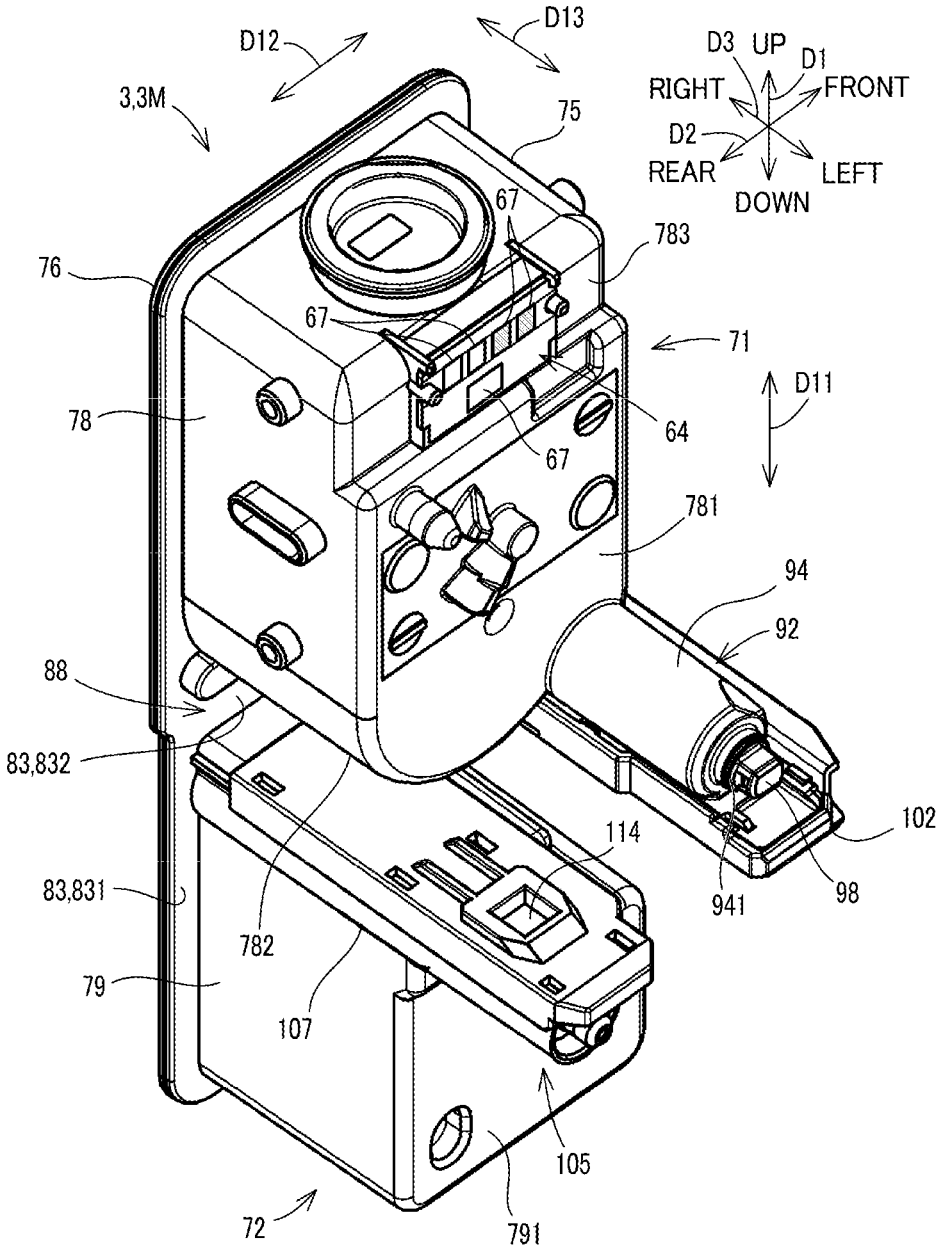

【FIG. 9】
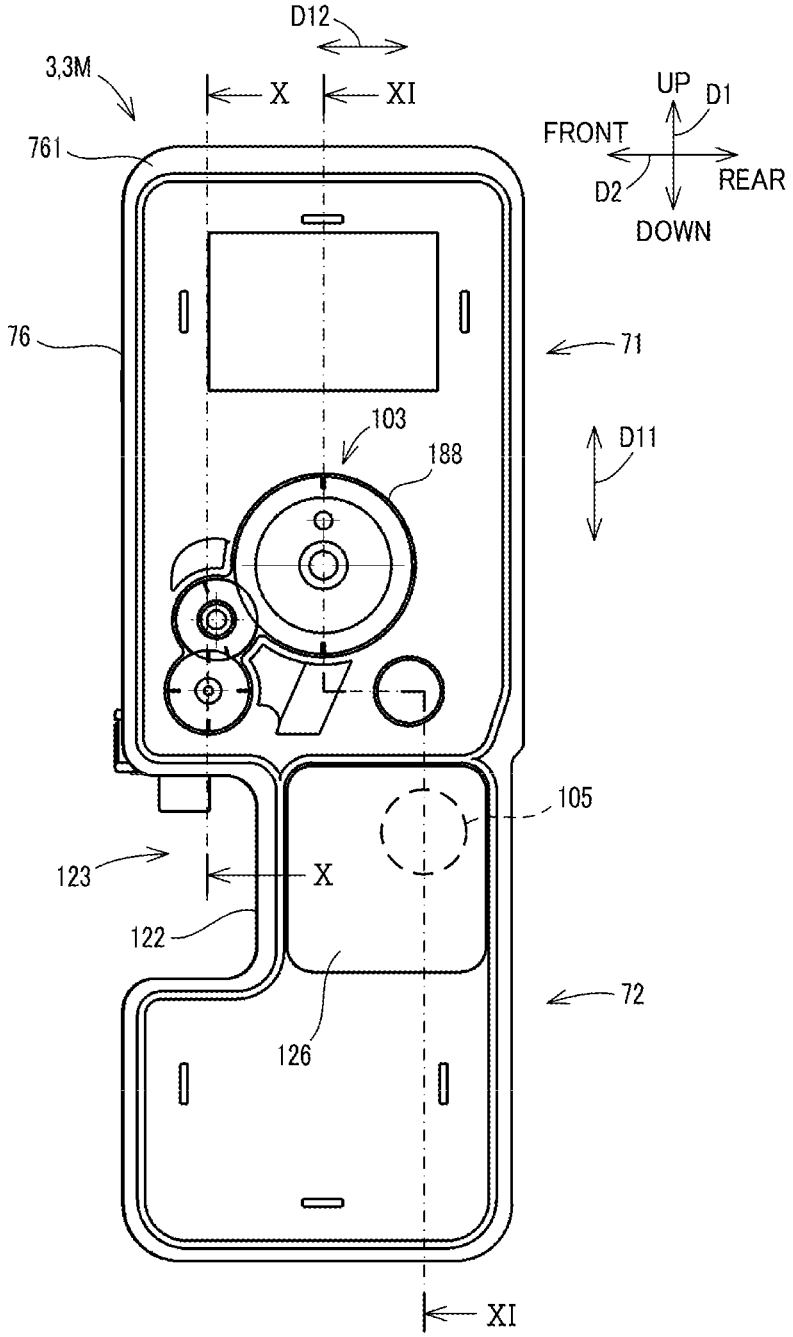

【FIG. 10】
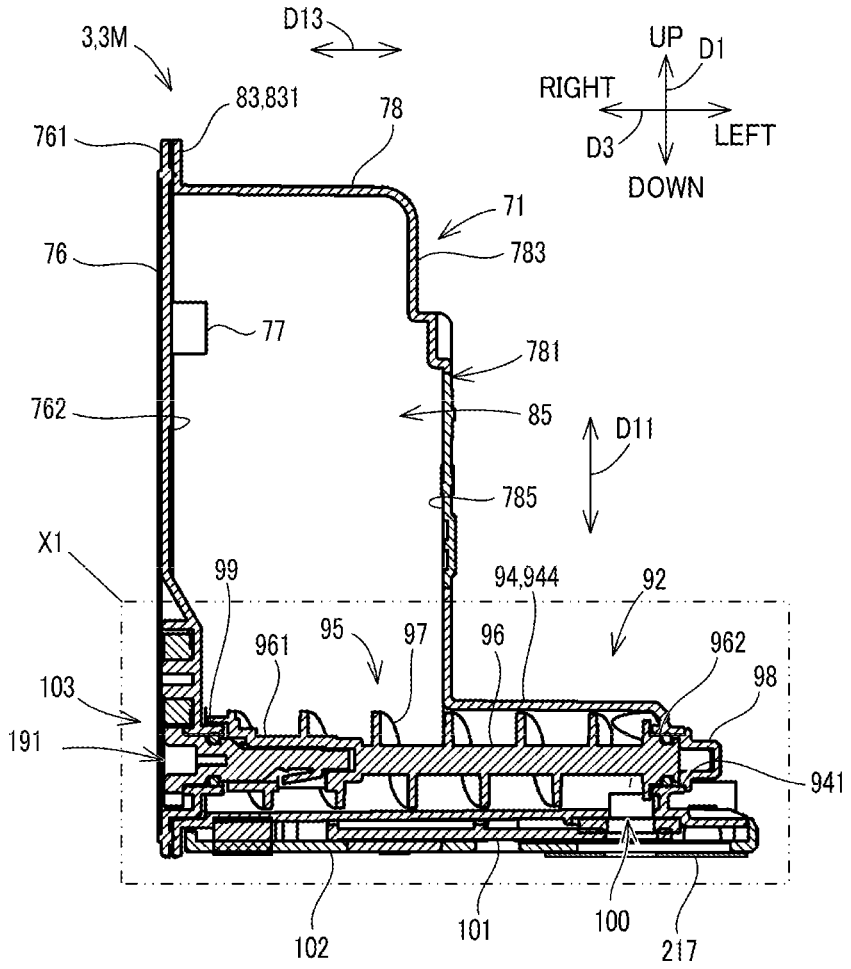

【FIG. 11】
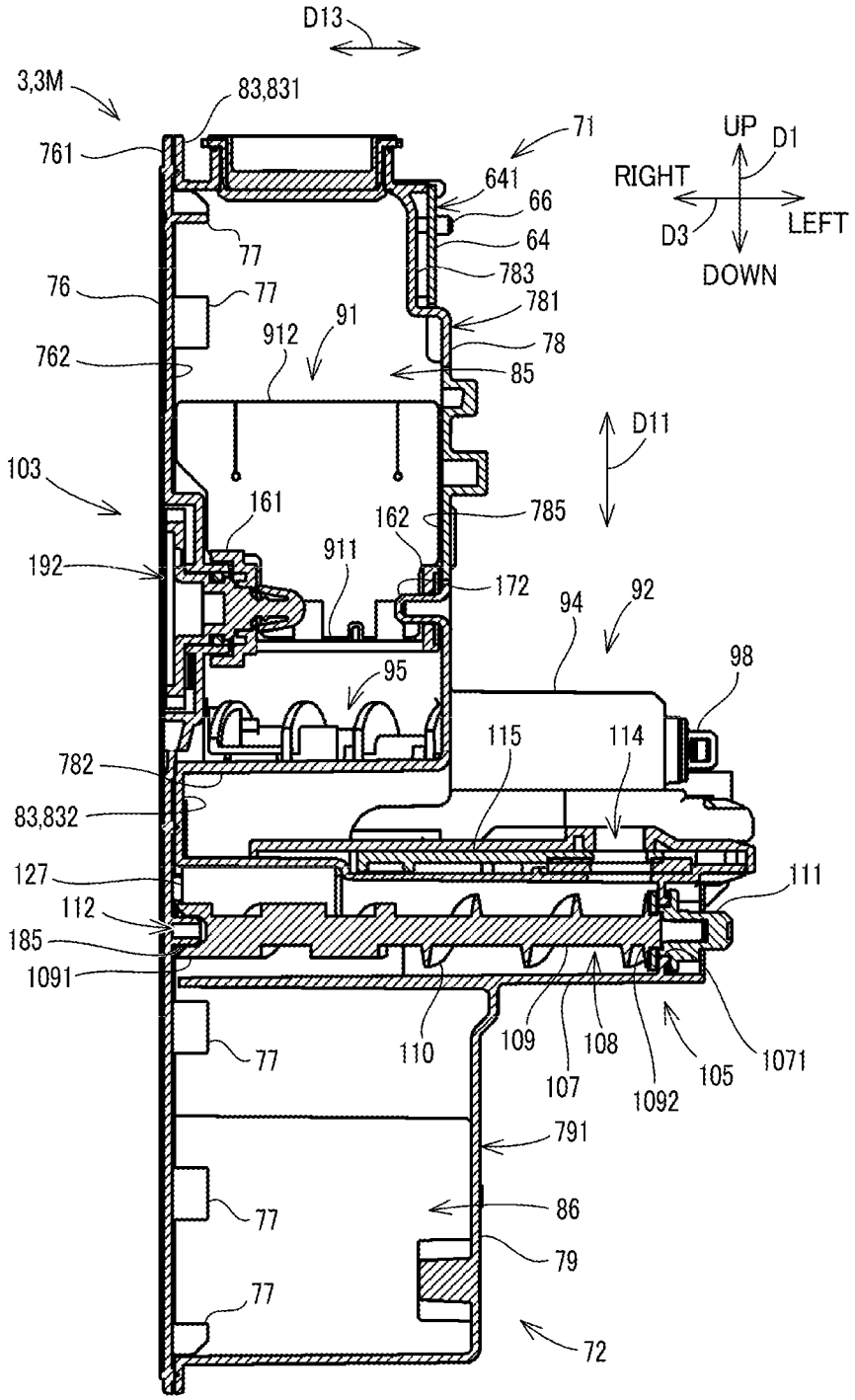

【FIG. 12】
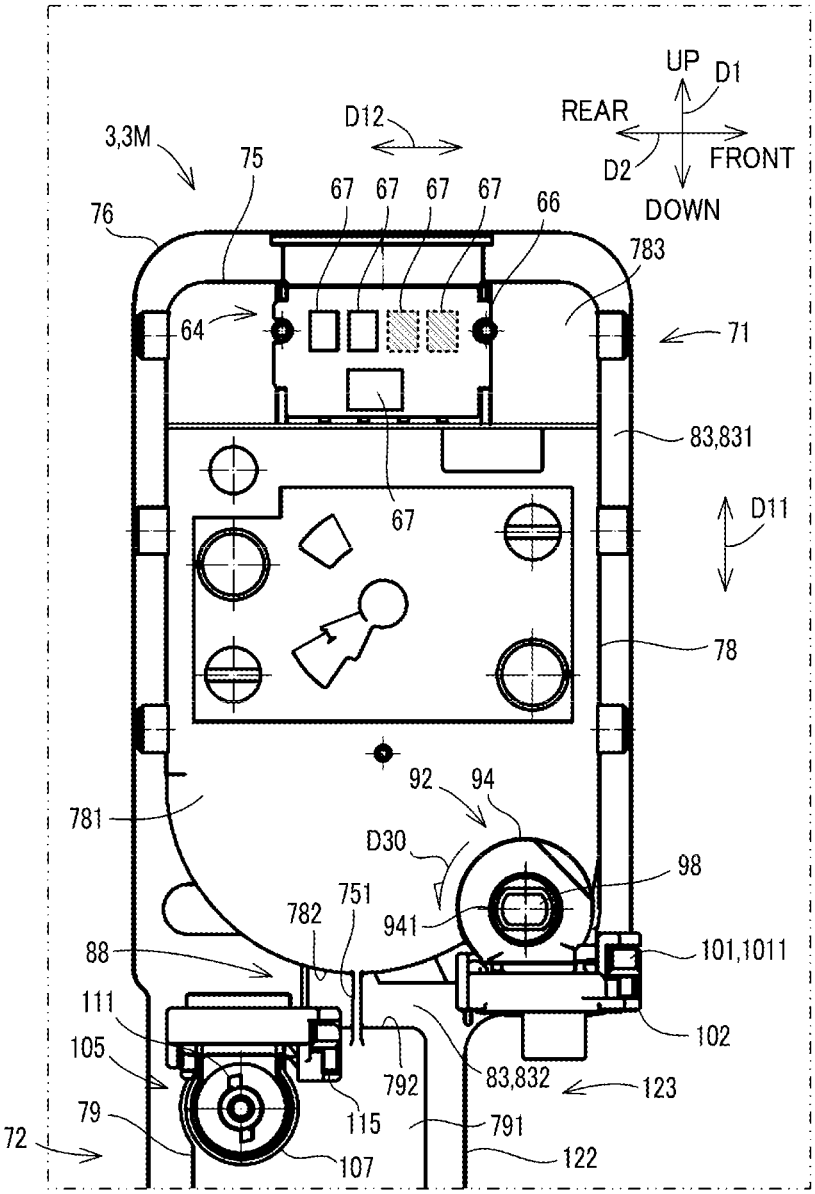

【FIG. 13】
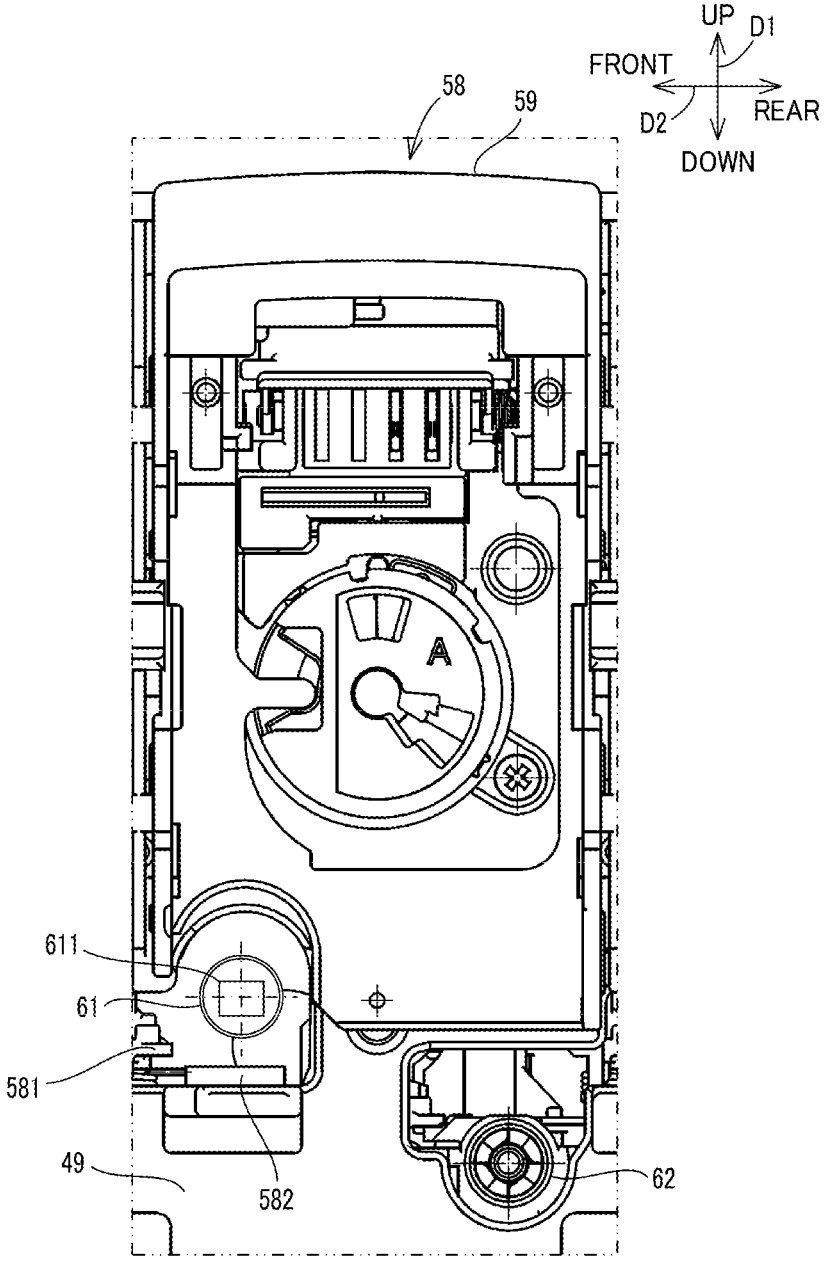

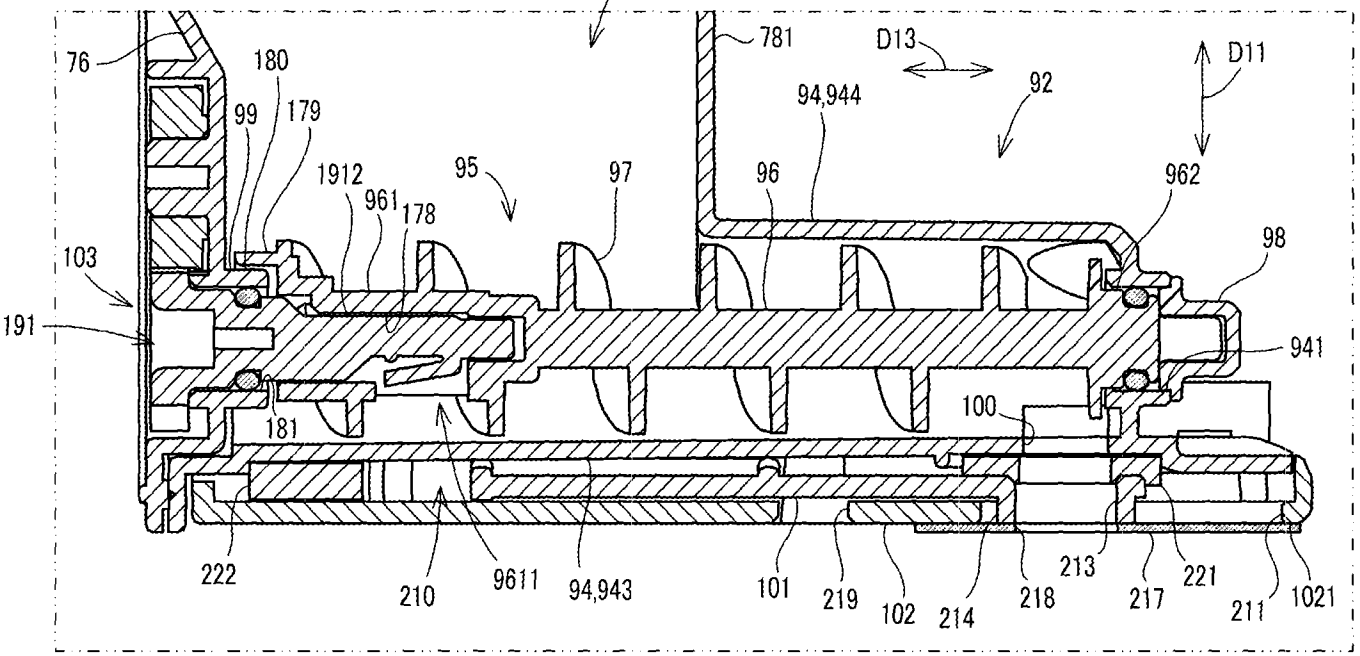
【FIG. 14】

【FIG. 15】
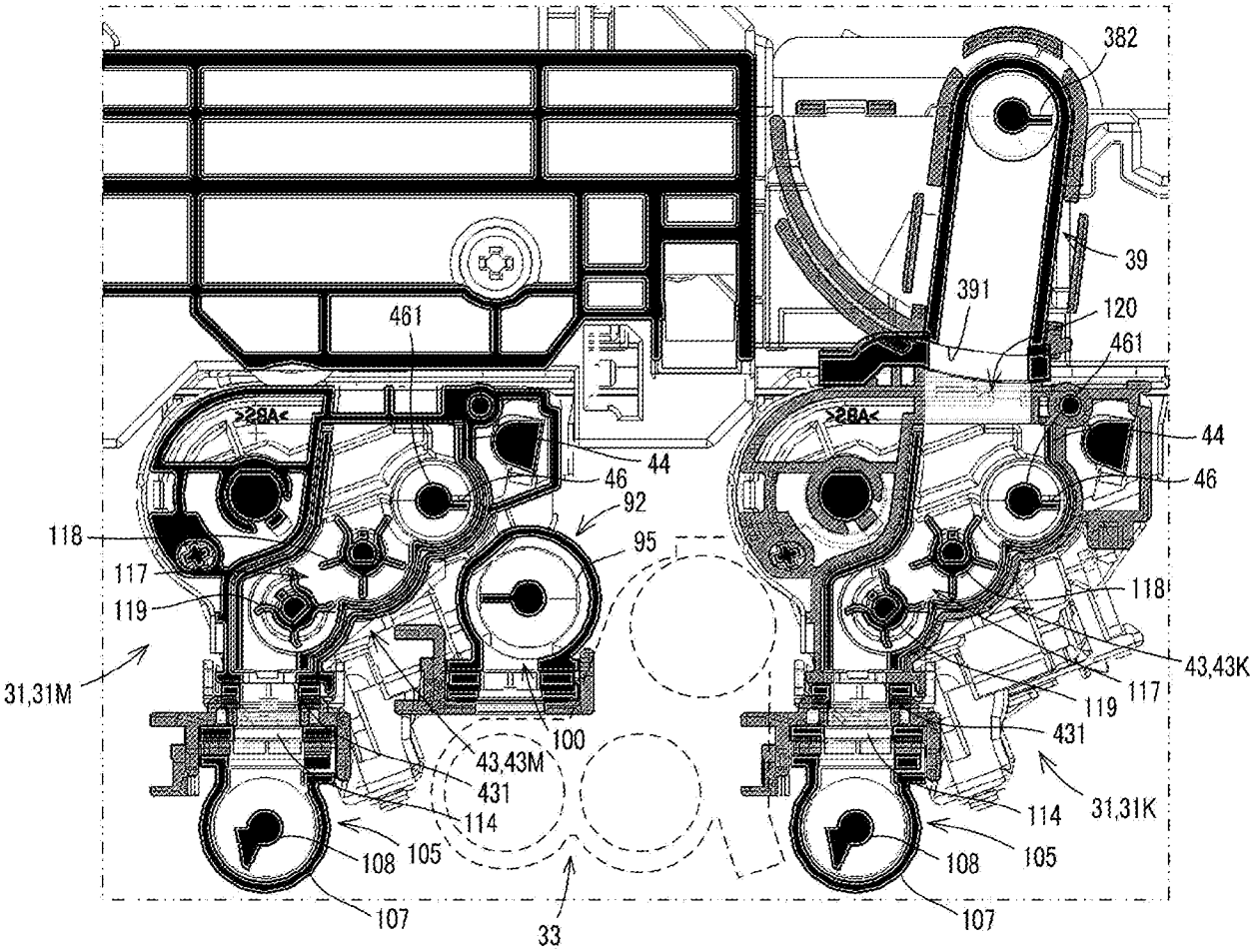

TONER CONTAINER, IMAGE FORMING APPARATUS

INCORPORATION BY REFERENCE

This application is based upon and claims the benefit of priority from the corresponding Japanese Patent Application No. 2016-114516 filed on Jun. 8, 2016, the entire contents of which are incorporated herein by reference.

BACKGROUND

The present disclosure relates to a toner container including a storage portion for storing toner, and relates to an image forming apparatus.

Conventionally, there is known an image forming apparatus that can form an image on a paper sheet by using developer that includes toner. In this type of image forming apparatus, a toner container for supplying toner to a developing device in the image forming apparatus is provided. The toner container is attached to an apparatus main body of the image forming apparatus in a detachable manner. When the toner in the toner container is consumed and the toner container becomes empty, the toner container is removed from the image forming apparatus to be replaced with a new toner container filled with unused toner.

In addition, the conventional image forming apparatus includes a cleaning device and a waste toner container, wherein the cleaning device removes used toner (waste toner) that has remained on a photoconductor drum after a transfer, and the waste toner container stores the waste toner removed by the cleaning device.

In addition, the conventional toner container includes a toner discharge port and an opening and closing member (shutter member), wherein the toner discharge port is used to supply toner to the developing device, and the opening and closing member is configured to open and close the toner discharge port. The toner discharge port is, for example, formed in a shape of being opened downward. The opening and closing member is supported by the toner container in such a way as to be able to move between a closing position of closing the toner discharge port and an opening position of opening the toner discharge port. The opening and closing member is moved from the closing position to the opening position in interlocking with an attachment operation in which the toner container is attached to the image forming apparatus. In addition, the opening and closing member is moved from the opening position to the closing position in interlocking with a removal operation in which the toner container is removed from the image forming apparatus.

SUMMARY

A toner container according to an aspect of the present disclosure includes a container main body, a toner discharge port, a first rotation member, a support plate, and an opening and closing member. The container main body is configured to store toner in an inside thereof and formed in an elongated shape. The toner discharge port is formed in a wall surface of the container main body and configured to discharge the toner stored in the container main body to outside. The first rotation member is rotatably provided in the container main body, extends in a depth direction of the container main body, and is configured to convey the toner stored in the container main body toward the toner discharge port, the depth direction being perpendicular to a longitudinal direction of the container main body. The support plate is provided in the container main body and disposed in such a way as to face the wall surface. The opening and closing member is provided in a gap formed between the wall surface and the support plate and supported by the support plate in such a way as to be able to move between a closing position of closing the toner discharge port and an opening position of opening the toner discharge port. The support plate includes a first opening portion and a film member. The first opening portion is formed at a position corresponding to the toner discharge port and larger than the toner discharge port in size. The film member is attached to the support plate in such a way as to cover the first opening portion, and includes a second opening portion formed at a position corresponding to the toner discharge port.

An image forming apparatus according to another aspect of the present disclosure includes an apparatus main body, a developing device, a drum unit, a cleaning portion, and a toner container. The developing device is included in the apparatus main body. The drum unit includes a photoconductor drum configured to rotate and carry a toner image developed by the developing device. The cleaning portion is included in the drum unit and configured to remove used toner that has remained on the photoconductor drum and convey the removed toner toward one side in an axis direction of a rotation shaft of the photoconductor drum. The toner container is attached, in a detachable manner, to an attachment portion included in the apparatus main body at a position that is more on the one side in the axis direction than the drum unit, and elongated in an up-down direction while the toner container is in an attachment attitude of being attached to the attachment portion. The toner container includes a first toner storage portion, a toner discharge port, a first rotation member, an opening and closing member, a support plate, a second toner storage portion, and a second rotation member. The first toner storage portion is configured to store unused toner that is to be supplied to the developing device, and provided in an upper part of the toner container in the attachment attitude. The toner discharge port is formed in a housing of the first toner storage portion, opened downward, and configured to supply the unused toner to the developing device. The first rotation member is rotatably provided in the first toner storage portion, extends in a depth direction perpendicular to the up-down direction, and is configured to convey the unused toner to the toner discharge port by being rotated. The opening and closing member is provided below the toner discharge port and configured to open and close the toner discharge port by moving between a closing position of closing the toner discharge port and an opening position of opening the toner discharge port. The support plate is provided in the first toner storage portion and configured to support, on an upper surface of the support plate, the opening and closing member in such a manner that the opening and closing member can move between the closing position and the opening position. The second toner storage portion is configured to store the used toner conveyed from the cleaning portion, and provided in a lower part of the toner container below the first toner storage portion while the toner container is in the attachment attitude. The second rotation member is rotatably provided in the second toner storage portion, extends in the depth direction, and is configured to convey the used toner conveyed from the cleaning portion, to the second toner storage portion by being rotated. The support plate includes a first opening portion and a film member. The first opening portion is located below the toner discharge port and larger than the toner discharge port in size. The film member is attached to the support plate in such a way as to cover the first opening portion, and includes a second opening portion formed at a position corresponding to the toner discharge port.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 1 is a perspective view showing a configuration of an image forming apparatus according to an embodiment of the present disclosure.

FIG. 2 is a cross section showing a configuration of the image forming apparatus.

FIG. 3 is a cross section schematically showing an internal structure of an image forming unit included in the image forming apparatus.

FIG. 4 is a diagram showing attachment portions to which toner containers are attached.

FIG. 5 is a perspective view showing configurations of toner containers for magenta and black.

FIG. 6 is a perspective view showing internal structures of the toner containers for magenta and black.

FIG. 7 is a perspective view showing a configuration of a rear side of the toner container for magenta.

FIG. 8 is a perspective view showing a configuration of the rear side of the toner container for magenta.

FIG. 9 is a diagram showing a configuration of a front side of the toner container for magenta.

FIG. 10 is a cross section taken along a X-X line of FIG. 9.

FIG. 11 is a cross section taken along an XI-XI line of FIG. 9.

FIG. 12 is a partial enlarged diagram showing a configuration of the rear side of the toner container for magenta.

FIG. 13 is a partial enlarged diagram showing a configuration of an attachment portion to which the toner container for magenta is attached.

FIG. 14 is a diagram showing a configuration of a first conveyance portion, and is an enlarged diagram of a main part X1 shown in FIG. 10.

FIG. 15 is a cross section showing a structure of a right-end portion of the image forming apparatus.

DETAILED DESCRIPTION

The following describes an embodiment of the present disclosure with reference to the drawings. It should be noted that the following embodiment is an example of a specific embodiment of the present disclosure and should not limit the technical scope of the present disclosure. It is noted that, for the sake of explanation, a vertical direction in an installed state of an image forming apparatus 10 where the image forming apparatus 10 is usable (the state shown in FIG. 1) is defined as an up-down direction D1. In addition, a front-rear direction D2 is defined on a supposition that a side to/from which a sheet feed cassette 22 shown in FIG. 1 is inserted and removed in the installed state is a front side. Furthermore, a left-right direction D3 is defined based on the front side of the image forming apparatus 10 in the installed state.

The image forming apparatus 10 according to the present embodiment has at least a print function. The image forming apparatus 10 is, for example, a tandem-type color printer.

As shown in FIG. 1 and FIG. 2, the image forming apparatus 10 includes a housing 11 (an example of the apparatus main body). The housing 11 has an approximately parallelepiped shape as a whole. Some of the components constituting the image forming apparatus 10 are stored in the housing 11. It is noted that FIG. 1 shows a state where a cover covering the right side of the housing 11 has been removed.

As shown in FIG. 2, the image forming apparatus 10 includes a plurality of image forming units 15 (15Y, 15C, 15M, and 15K), an intermediate transfer unit 16, a laser scanning device 17, a primary transfer roller 18, a secondary transfer roller 19, a fixing device 20, a sheet tray 21, the sheet feed cassette 22, a conveyance path 24, and a control board 26 configured to control the portions of the image forming apparatus 10. In addition, the image forming apparatus 10 includes toner containers 3 (see FIG. 1) that have been attached to the inside of the housing 11 in a detachable manner. In the present embodiment, the image forming apparatus 10 includes four image forming units 15.

FIG. 3 is a cross-sectional view of a central portion of an image forming unit 15. The image forming unit 15 forms a toner image by the electrophotography. As shown in FIG. 3, each of the image forming units 15 includes a drum unit 31, a charging device 32, and a developing device 33.

As shown in FIG. 2, the image forming units 15 are arranged in alignment along the front-rear direction D2 in the housing 11, and form a color image based on the so-called tandem system. Specifically, the image forming unit 15Y is configured to form a toner image of yellow. In addition, the image forming units 15C, 15M and 15K are configured to form toner images of cyan, magenta and black, respectively. The image forming units 15Y for yellow, 15C for cyan, 15M for magenta, and 15K for black are arranged in alignment in the stated order from the downstream side in the running direction (the direction indicated by the arrow D10) of a transfer belt 35 of the intermediate transfer unit 16.

The drum unit 31 includes a photoconductor drum 41, a drum cleaning device 42 (an example of the drum cleaning portion), a discharge guide portion 43 (see FIG. 15), and a housing 44 that supports these components. The housing 44 is elongated in the left-right direction D3. The photoconductor drum 41 has a cylindrical shape and carries a toner image developed by the developing device 33. The photoconductor drum 41 is rotatably supported by the housing 44.

In each of the image forming units 15, the charging device 32 uniformly charges the photoconductor drum 41 to a certain potential. Subsequently, the laser scanning device 17 irradiates a laser beam on the surface of the photoconductor drum 41 based on the image data. In this processing, electrostatic latent images are formed on the surfaces of the photoconductor drums 41, respectively. The electrostatic latent images are developed (visualized) as toner images by the developing devices 33, respectively. The toner images of respective colors formed on the surfaces of the photoconductor drums 41 are transferred to the transfer belt 35 by the primary transfer roller 18 such that the toner images are overlaid with each other in sequence. Next, the color image on the transfer belt 35 is transferred by the secondary transfer roller 19 to a print sheet. The color image transferred to the print sheet is fixed to the print sheet by the fixing device 20, and thereafter, the print sheet is discharged from a sheet discharge port 28 to the sheet tray 21.

The drum cleaning device 42 is configured to remove toner that has remained on the photoconductor drum 41 after the transfer. The drum cleaning device 42 is disposed on the rear side of the photoconductor drum 41. The drum cleaning device 42 is provided for each photoconductor drum 41. The drum cleaning device 42 includes a cleaning blade 45 that is a cleaning member, and a spiral member 46. The cleaning blade 45 and the spiral member 46 are elongated in the left-right direction D3. The cleaning blade 45 and the spiral member 46 are supported by the housing 44. The cleaning blade 45 has approximately the same length as the photoconductor drum 41. The tip of the cleaning blade 45 is disposed so as to be in contact with or close to the surface of the photoconductor drum 41. The spiral member 46 is a toner conveyance member having a spiral blade around a shaft. The spiral member 46 is rotatably supported in the housing 44.

The spiral member 46 is rotated when a rotational driving force is input to its shaft. While the photoconductor drum 41 is rotated, the cleaning blade 45 removes toner that has remained on the surface of the photoconductor drum 41 after the transfer by the primary transfer roller 18. The removed toner is to be discarded later, and thus called waste toner in general. The waste toner is conveyed toward a certain direction by the rotating spiral member 46. Specifically, the waste toner is conveyed toward one side (in the present embodiment, the right side) in the axis direction (longitudinal direction) of the photoconductor drum 41.

As shown in FIG. 15, the discharge guide portion 43 is disposed at the right end of the housing 44. The waste toner is guided downward by the discharge guide portion 43, passes through a discharge port 431 (see FIG. 15) that is described below, and is discharged to a lower storage portion 72 of the toner container 3. It is noted that the discharge guide portion 43 is described below.

As shown in FIG. 3, the developing device 33 includes a housing 50, a first stirring member 52, a second stirring member 53, and a developing roller 54. Toner (developer) is stored in a bottom portion of the housing 50 and the toner is conveyed while being stirred by the first stirring member 52 and the second stirring member 53. A supply port 56 is formed in a wall 51 of the housing 50 that is located above the first stirring member 52. The supply port 56 is formed at the right end of the wall 51. The toner discharged from the toner container 3 is supplied from the supply port 56 into the housing 50. The developing roller 54 draws up the toner from the second stirring member 53 by the magnetic pole embedded therein, and carries the toner on its circumferential surface. The toner held on the developing roller 54 is caused to adhere to the electrostatic latent image on the photoconductor drum 41 by the potential difference applied to between the developing roller 54 and the photoconductor drum 41.

As shown in FIG. 1, a plurality of toner containers 3 (3Y, 3C, 3M and 3K) are attached to the inside of the housing 11. Specifically, the four toner containers 3 are respectively attached to attachment portions 58 (see FIG. 4) provided in the inside of the housing 11. In addition, in the present embodiment, a plurality of toner containers 3 are attached in a state of being aligned along the front-rear direction D2, and a toner container 3K for black is disposed at the rear-most position.

Each of the toner containers 3 includes an upper storage portion 71 (an example of the first toner storage portion) and a lower storage portion 72 (an example of the second toner storage portion). The upper storage portion 71 includes, inside thereof, a storage space 85 (see FIG. 6) for storing toner, and unused toner for supply is stored in the storage space 85. The lower storage portion 72 includes, inside thereof, a storage space 86 (see FIG. 6) for storing toner, and the waste toner discharged from the drum cleaning device 42 is stored in the storage space 86. In the state where the toner containers 3 are respectively attached to the attachment portions 58, the unused toner is supplied to the insides of the developing devices 33 from the upper storage portions 71 of the toner containers 3. In addition, waste toner discharged from the drum cleaning devices 42 passes through the discharge guide portions 43 (see FIG. 15), and is stored in the lower storage portions 72 of the toner containers 3. As shown in FIG. 1, in the present embodiment, the four toner containers 3 are located at the right side of the image forming units 15 inside a right-side cover (not shown) of the housing 11. The toner containers 3 are arranged on the right side of the housing 11 in alignment along the front-rear direction D2. The toner containers 3 are described in detail below.

As shown in FIG. 2, the intermediate transfer unit 16 is provided above the four image forming units 15. More specifically, the intermediate transfer unit 16 is provided above the photoconductor drums 41. The intermediate transfer unit 16 includes the transfer belt 35, a driving roller 36, a driven roller 37, a belt cleaning device 38 (an example of the belt cleaning portion), and a relay guide portion 39 (see FIG. 15). It is noted that the primary transfer roller 18 is supported by a frame (not shown) of the intermediate transfer unit 16.

The transfer belt 5, an annular belt member, is suspended between the driving roller 36 and the driven roller 37 so as to extend in the front-rear direction D2. A plurality of drum units 31 are arranged in alignment in the front-rear direction D2 along the transfer belt 35. The transfer belt 35 holds, on its surface, toner images primarily transferred from the photoconductor drums 41. When the transfer belt 35 is rotationally driven and moves in a direction indicated by the arrow D10, the toner images of respective colors carried by the photoconductor drums 41 are transferred to the transfer belt 35 such that the toner images are overlaid with each other in sequence.

The belt cleaning device 38 is disposed in the vicinity of the fixing device 20. Specifically, the belt cleaning device 38 is provided above the transfer belt 35 in the rear side of the housing 11. Below the belt cleaning device 38, the image forming unit 15K, which is an image forming unit 4 for black, is disposed. That is, the belt cleaning device 38 is located closest to the image forming unit 15K for black among the plurality of image forming units 4.

The belt cleaning device 38 is configured to remove the waste toner that has remained on the surface of the transfer belt 35, and convey the removed waste toner toward the lower storage portion 72 of the toner container 3K. The belt cleaning device 38 includes a cleaning roller 381 that is elongated in the left-right direction D3, a spiral member 382 as a conveyance member for conveying the waste toner, and a housing 383 for storing these components (see FIG. 2). The cleaning roller 381 is configured to remove the waste toner from the surface of the transfer belt 35 by rotating while in contact with the surface of the transfer belt 35. The used toner thus removed (hereinafter referred to as "waste toner") is conveyed in a certain direction by the spiral member 382 as it rotates. Specifically, the waste toner is conveyed toward one side in the width direction (a direction that matches the left-right direction D3) of the transfer belt 35 (in the present embodiment, conveyed toward the right side).

As shown in FIG. 15, the relay guide portion 39 is provided at the right end of the housing 383. The waste toner is guided downward by the relay guide portion 39, passes through a discharge guide portion 43K of a drum unit 31K disposed at the rear-most position, and is conveyed to the lower storage portion 72 of the toner container 3K. It is noted that the relay guide portion 39 is described below.

FIG. 15 is a partial enlarged diagram showing a cross-sectional structure of a right-end portion of the drum units 31 of the image forming units 15. FIG. 15 shows cross-sectional structures of the drum unit 31M for magenta and the drum unit 31K for black. For the sake of explanation, in FIG. 15, a developing device 33 corresponding to the drum unit 31K is represented by a dotted line. As shown in FIG. 15, a discharge guide portion 43M is provided at the right end of the housing 44 of the drum unit 31M. That is, the discharge guide portion 43M is provided in the drum unit 31M. It is noted that a discharge guide portion 43 having the same structure as the discharge guide portion 43M is provided in each of the drum units 31 for yellow and cyan.

The discharge guide portion 43M guides the waste toner that has been removed by the drum cleaning device 42 in the drum unit 31M and conveyed to the right end of the housing 44, to an inlet 114 of the lower storage portion 72 of the toner container 3M. An inner space of the discharge guide portion 43M is a passage 117 in which the waste toner passes. The discharge guide portion 43M extends diagonally downward from above, and the discharge port 431 connected to the inlet 114 is formed at a lower end of the discharge guide portion 43M.

In the passage 117, a right end portion 461 of the spiral member 46 is disposed. The end portion 461 is rotatably supported by the discharge guide portion 43M. When a rotational driving force is transmitted to the end portion 461, the spiral member 46 rotates, and the waste toner is conveyed to the passage 117 of the discharge guide portion 43M.

In the passage 117, two paddle portions 118 and 119 are provided in a region from the end portion 461 to the discharge port 431. The rotation shaft of each of the paddle portions 118 and 119 is rotatably supported by the discharge guide portion 43M. The rotational driving force of the spiral member 46 is transmitted to the paddle portions 118 and 119 via a gear transmission mechanism (not shown). When the spiral member 46 is rotated, its rotational driving force is transmitted to the paddle portions 118 and 119 via the gear transmission mechanism, and the paddle portions 118 and 119 are rotated. When the paddle portions 118 and 119 rotate, the waste toner that has been conveyed to the passage 117 is conveyed in the passage 117 to the discharge port 431 by the paddle portions 118 and 119, is further passed through the inlet 114 and a first conveyance guide portion 94 (an example of the first guide portion) of the toner container 3M, and guided into the lower storage portion 72 of the toner container 3M.

As shown in FIG. 15, a discharge guide portion 43K is provided at the right end of the housing 44 of the drum unit 31K. That is, the discharge guide portion 43K is provided in the drum unit 31K. The discharge guide portion 43K guides the waste toner that has been removed by the drum cleaning device 42 in the drum unit 31K and conveyed to the right end of the housing 44, to the inlet 114 of the lower storage portion 72 of the toner container 3K. The discharge guide portion 43K and the discharge guide portion 43M have some components in common. As a result, the components common to these portions are assigned the same reference signs, and description thereof is omitted.

The discharge guide portion 43K differs from the discharge guide portion 43M in that a receiving port 120 is formed at the top of the discharge guide portion 43K. The receiving port 120 is an opening from which the waste toner discharged from the belt cleaning device 38 is received. The receiving port 120 is connected to a discharge port 391 of the relay guide portion 39 that is described below. The waste toner that has entered the receiving port 120 is guided to the inlet 114 of the lower storage portion 72 of the toner container 3K by the discharge guide portion 43K, together with the waste toner discharged from the drum cleaning device 42.

As shown in FIG. 15, the relay guide portion 39 is provided at the right end of the belt cleaning device 38. The relay guide portion 39 guides the waste toner that has been conveyed to the right end of the housing 383 through the belt cleaning device 38 by the spiral member 382, to the discharge guide portion 43K. The discharge port 391 is formed in a lower portion of the relay guide portion 39, and the discharge port 391 is connected to the receiving port 120 of the discharge guide portion 43K. With this configuration, the waste toner discharged from the belt cleaning device 38 passes through the relay guide portion 39 and moves downward, and is guided through the discharge port 391 to the receiving port 120. The waste toner guided to the receiving port 120 passes through the discharge guide portion 43K, is conveyed further downward by the paddle portions 118 and 119, passes through the discharge port 431, the inlet 114, and a second conveyance guide portion 107 (an example of the second guide portion) of the toner container 3K, and is guided into the lower storage portion 72 of the toner container 3K.

As shown in FIG. 4, four attachment portions 58 for supporting the toner containers 3 in a detachable manner are provided at the right end of the housing 11. The attachment portions 58 are fixed to a support plate 49 provided at the right end of the housing 11. Each attachment portion 58 includes a bracket 59 for supporting a corresponding toner container 3. The toner containers 3 are supported by corresponding brackets 59 in a detachable manner.

In the following, the configuration of the toner container 3M for magenta is described. FIG. 5 and FIG. 6 show the toner container 3M and the toner container 3K disposed next to the toner container 3M.

The toner container 3K is larger in outer shape and capacity than the toner container 3M since the toner container 3K stores black toner that is used much, but except for this, they have approximately the same configuration. As a result, components of the toner container 3K that are the same as those of the toner container 3M are assigned the same reference signs, and description thereof is omitted. In addition, the toner containers 3Y and 3C have the same configuration as the toner container 3M, thus description thereof is omitted.

It is noted that the drawings show the up-down direction D1, the front-rear direction D2 and the left-right direction D3 based on an attachment attitude of the toner containers 3M and 3K attached to the attachment portions 58 (see FIG. 4). In the following, with respect to the toner containers 3M and 3K in the attachment attitude, the up-down direction D1 is defined as a height direction D11 of the toner containers 3M and 3K, the front-rear direction D2 is defined as a width direction D12 of the toner containers 3M and 3K, and the left-right direction D3 is defined as a depth direction D13 of the toner containers 3M and 3K.

As shown in FIG. 5 and FIG. 6, the toner container 3M includes a container main body 75. The container main body 75 is a resin product formed by injection molding a synthetic resin. The container main body 75 is elongated in the height direction D11, broad in the width direction D12, and shallow in the depth direction D13.

The container main body 75 includes an upper case 78 (an example of the first housing) formed in the upper side thereof, a lower case 79 (an example of the second housing) formed in the lower side thereof, and a lid member 76 (an example of the lid member). That is, the upper case 78 is formed in one side (upper side) of the container main body 75 in the height direction D11 (longitudinal direction), and the lower case 79 is formed in the other side (lower side) of the container main body 75 in the height direction D11 (longitudinal direction). The upper case 78 and the lower case 79 are integrally formed as the container main body 75. In the upper case 78, the storage space 85 for storing the unused toner is defined. That is, the storage space 85 in the upper storage portion 71 is defined by the upper case 78. In addition, in the lower case 79, the storage space 86 for storing the waste toner is defined. That is, the storage space 86 in the lower storage portion 72 is defined by the lower case 79.

The upper case 78 and the lower case 79 are separated from each other in the up-down direction D1, and a gap 88 (see FIG. 7) having a predetermined distance is formed between the upper case 78 and the lower case 79. Specifically, as shown in FIG. 7 and FIG. 12, the upper case 78 includes a bottom wall 782 that constitutes the bottom wall surface thereof and is formed in an arc shape, and the lower case 79 includes a top wall 792 that constitutes the top wall surface thereof. The gap 88 is formed between the bottom wall 782 and the top wall 792. Here, the bottom wall 782 and the top wall 792 are an example of the pair of walls that are separated from each other in the height direction D11.

An opening portion 81 is formed in the right side surface of the upper case 78, and an opening portion 82 is formed in the right side surface of the lower case 79. The opening portions 81 and 82 are formed on the same plane. A flange 83 is formed along opening edges of the opening portions 81 and 82. The flange 83 is formed in the shape of a plate having a thickness in the depth direction D13. The flange 83 includes a peripheral flange 831 and a central flange 832 (an example of the coupling member and the common flange). The peripheral flange 831 is formed around the outer periphery of the right side surface of the container main body 75. The central flange 832 is, as shown in FIG. 12, formed at a position corresponding to the gap 88 so as to couple the bottom wall 782 of the upper case 78 with the top wall 792 of the lower case 79. More specifically, the central flange 832 is continued from the lower edge of the opening portion 81 to the upper edge of the opening portion 82. In other words, the central flange 832 is a flange common to the opening portion 81 and the opening portion 82. In the present embodiment, the bottom wall 782 and the top wall 792 extend from the central flange 832 in the depth direction D13.

The lid member 76 is a resin product formed by injection molding a synthetic resin. As shown in FIG. 5, the lid member 76 covers the opening portion 81 and the opening portion 82. The lid member 76 is a flat plate-like member and is formed in the shape that matches the peripheral shape of the flange 83. In a state where an outer periphery 761 of the lid member 76 is aligned with the flange 83, the outer periphery 761 and the flange 83 are welded.

With the opening portion 81 and the opening portion 82 being closed by one lid member 76, the upper storage portion 71 having the storage space 85 and the lower storage portion 72 having the storage space 86 are provided. In this way, since the upper storage portion 71 and the lower storage portion 72 are coupled with each other by the central flange 832 and the lid member 76, in the toner container 3M, a portion around the gap 88 is smaller in strength than the other portions. As a result, the toner container 3M can be easily bent at the vicinity of the gap 88 in the width direction D12 and in the depth direction D13, and can be easily bent in the rotation direction around the height direction D11 as the axis of rotation.

As shown in FIG. 7 and FIG. 12, a plate-like reinforcing rib 751 is disposed between the bottom wall 782 of the upper case 78 and the top wall 792 of the lower case 79. The reinforcing rib 751 extends in the depth direction D13 vertically from the central flange 832. As shown in FIG. 12, the reinforcing rib 751, coupled with the bottom wall 782 and the top wall 792, is a plate-like member having a thickness in the width direction D12. As shown in FIG. 7, the left-end surface of the reinforcing rib 751 is inclined diagonally upward left from the top wall 792 to the bottom wall 782, and more specifically, inclined in a curved shape. With the provision of the reinforcing rib 751 as such, the strength at the vicinity of the gap 88 between the upper storage portion 71 and the lower storage portion 72 is reinforced. As a result, the toner container 3M is prevented from being excessively bent at the vicinity of the gap 88, in particular, prevented from being excessively bent in the depth direction D13.

As shown in FIG. 8 and FIG. 11, the lower storage portion 72 of the toner container 3M is larger in size in the depth direction D13 than the upper storage portion 71. That is, the size in the depth direction D13 of the lower storage portion 72 of the toner container 3M is larger than that of the upper storage portion 71. In addition, the size in the height direction D11 of the upper storage portion 71 is larger than that of the lower storage portion 72, and the upper storage portion 71 and the lower storage portion 72 have approximately the same size in the width direction D12. In the configuration where the upper storage portion 71 and the lower storage portion 72 are separate in the up-down direction D1, there may be a case where each of the upper storage portion 71 and the lower storage portion 72 cannot secure an enough capacity for storing toner. However, with the above-described configuration where the upper storage portion 71 and the lower storage portion 72 have different sizes in the height direction D11 and the depth direction D13, it is possible to secure an enough capacity for each of the upper storage portion 71 and the lower storage portion 72 in spite of various constraints in the attachment to the attachment portion 58.

As shown in FIG. 6, the upper storage portion 71 includes a stirring member 91 (an example of the third rotating member) and a first conveyance portion 92. Specifically, a paddle-like stirring member 91 is provided in the upper storage space 85. The stirring member 91 is supported by the upper case 78 so as to be rotatable in the storage space 85. In addition, the first conveyance portion 92 for conveying toner to the developing device 33 is provided in the storage space 85.

As shown in FIG. 7 and FIG. 8, the first conveyance portion 92 includes a first conveyance guide portion 94 and a spiral member 95, wherein the first conveyance guide portion 94 is cylindrical and extends outward from a wall surface 781 (an example of the facing surface) of the left side of the upper case 78, and the spiral member 95 (an example of the first rotating member, see FIG. 10) is provided in the inside of the first conveyance guide portion 94. The first conveyance guide portion 94 is integrally formed with the upper case 78 in the shape of a cylinder whose center is the same as the rotation center of the spiral member 95. Here, the wall surface 781 is located in one side of the toner container 3M with respect to the attachment portion 58 in the depth direction D13, and is a surface that faces the attachment portion 58 when the toner container 3M is attached to the attachment portion 58. It is noted that the depth direction D13 matches the direction in which the toner container 3M is attached to and detached from the attachment portion 58.

The spiral member 95 is rotatably provided in the upper storage portion 71, and as shown in FIG. 10, extends in the depth direction D13 that is perpendicular to the height direction D11. The spiral member 95 is a conveyance member that conveys the unused toner in the storage space 85 toward the attachment portion 58 (see FIG. 4) through the inside of the first conveyance guide portion 94. In addition, the first conveyance guide portion 94 is a guide member that guides the unused toner conveyed by the spiral member 95 to the developing device 33.

As shown in FIG. 10, the spiral member 95 includes blades 97 of a spiral shape around a rotation shaft 96. An end portion 961 (an example of the first end portion) of the rotation shaft 96 of the spiral member 95 on the lid member 76 side is rotatably supported by a bearing portion 99 (an example of the first bearing portion) that is integrally formed with an inner surface 762 of the lid member 76. In addition, in a state where the spiral member 95 is inserted in the first conveyance guide portion 94, the opposite end of the rotation shaft 96 is rotatably supported by the first conveyance guide portion 94. Specifically, a first input portion 98 (an example of the first drive input portion and the second input joint) is integrally formed with an end portion 962 that is the opposite end of the rotation shaft 96, wherein the first input portion 98 receives a rotational driving force input from outside. In addition, a through hole 941 is formed in the tip of the first conveyance guide portion 94. In the state where the first input portion 98 projects from the through hole 941 to the outside, the end portion 962 is rotatably supported by the through hole 941.

In the following, the support structure of the end portion 961 of the spiral member 95 is described concretely with reference to FIG. 14. Here, FIG. 14 is an enlarged view of a main part X1 that is enclosed by a two-dot chain line in FIG. 10.

As shown in FIG. 14, the end portion 961 of the rotation shaft 96 (an example of the first rotation shaft) includes an inner hole 178 that extends along the axial direction from an end surface of the rotation shaft 96 on the lid member 76 side toward the opposite side. That is, the end portion 961 is a cylinder portion formed in a cylindrical shape so as to have the inner hole 178 in its inside. The inner hole 178 is formed in a size that allows a first coupling portion 1912 of a first transmission portion 191 described below to be inserted therethrough. On an end surface of the end portion 961 on the lid member 76 side, an arc-shaped support portion 179 whose outer diameter is larger than the inner hole 178 is formed. It is noted that an engagement opening 9611 (an example of the first engagement opening) is formed on an outer circumferential surface of the end portion 961, wherein a first engaging portion 197 described below is engaged with the engagement opening 9611 when the first coupling portion 1912 described below is inserted through the inner hole 178. The engagement opening 9611 penetrates to the inner hole 178 of the end portion 961.

In addition, as described above, the bearing portion 99 is provided on the inner surface 762 of the lid member 76. The bearing portion 99 includes a boss 180 (an example of the first boss) that projects vertically from the inner surface 762 of the lid member 76. The boss 180 is inserted in the support portion 179 of the end portion 961 such that the end portion 961 is supported by the boss 180. It is noted that a through hole 181 (an example of the first through hole) is formed at the center of a projection end of the boss 180, wherein the first coupling portion 1912 of the first transmission portion 191 described below can be inserted through the through hole 181.

With the above-described configuration of the bearing portion 99 and the end portion 961, when a rotational driving force is input to the rotation shaft 96 of the spiral member 95, the spiral member 95 is rotated in one direction in the storage space 85. In the present embodiment, when a rotational driving force is input to the first input portion 98, the spiral member 95 is rotated in a rotation direction D30 shown in FIG. 12. This allows the unused toner in the storage space 85 to be conveyed in the first conveyance guide portion 94 toward the tip portion of the first conveyance guide portion 94.

A toner discharge port 100 is formed in the upper case 78 so that toner stored in the storage space 85 can be discharged from the toner discharge port 100 to outside. As shown in FIG. 10, the toner discharge port 100 is formed in a lower part of an outer circumferential surface (hereinafter merely referred to as a lower surface) of the first conveyance guide portion 94. The toner discharge port 100 is a through-opening that penetrates, vertically downward, an outer circumferential wall constituting the lower surface of the first conveyance guide portion 94. The toner discharge port 100 is formed in an approximately square shape. In the present embodiment, the toner discharge port 100 is formed in an end portion of the lower surface of the first conveyance guide portion 94 at a position closest to the first input portion 98.

In addition, on the lower surface of the first conveyance guide portion 94, a shutter member 101 (an example of the opening and closing member) for opening and closing the toner discharge port 100 is provided. The shutter member 101 is supported by the first conveyance guide portion 94 in such a manner that the shutter member 101 can slide the lower surface of the first conveyance guide portion 94 in the longitudinal direction (the left-right direction of FIG. 10) of the first conveyance guide portion 94.

In the present embodiment, when the toner container 3M is attached to the attachment portion 58 (see FIG. 4), the shutter member 101 is moved from a closing position of closing the toner discharge port 100, to an opening position of opening the toner discharge port 100.

Specifically, as shown in FIG. 13, the attachment portion 58 includes a projection piece 581 which is configured to press an end portion 1011 of the shutter member 101 when the toner container 3M is attached to the attachment portion 58. The projection piece 581 presses the end portion 1011 of the shutter member 101 in an opposite direction to the attachment direction, causing the shutter member 101 to be moved from the closing position to the opening position. In addition, when the toner container 3M is removed from the attachment portion 58, the projection piece 581 is hooked to the end portion 1011 of the shutter member 101 during the removal operation, causing the shutter member 101 to be moved from the opening position to the closing position.

In addition, the toner discharge port 100 is aligned with the supply port 56 of the developing device 33 for positioning, then the toner discharge port 100 is connected to the supply port 56 so that toner can be supplied from the toner discharge port 100 to the supply port 56. In addition, the first input portion 98 is coupled with a first output joint 61 (an example of the drive output portion and the first drive coupling portion, see FIG. 13) that is provided in the attachment portion 58, and a rotational driving force output from a drive source such as a motor is transmitted to the first input portion 98. Upon receiving the rotational driving force, the spiral member 95 is rotated, and the toner in the storage space 85 is conveyed from the toner discharge port 100 to the supply port 56 via the first conveyance guide portion 94, and is supplied to the inside of the developing device 33.

It is noted that an engagement hole 611 which is rectangular in a cross section (see FIG. 13) is formed in the first output joint 61. The first input portion 98 is inserted in the engagement hole 611 such that the first output joint 61 is engaged with the first input portion 98 in a direction of rotation around the axis. This allows the rotational driving force received from the first output joint 61 to be transmitted to the first input portion 98. In this case, the first input portion 98 is an example of the engaging portion.

As shown in FIG. 13, the first output joint 61 is provided in the attachment portion 58. The first output joint 61 is a drive output portion configured to output the rotational driving force that is output from a drive source such as a motor provided in the image forming apparatus 10, to the outside. The first output joint 61 is coupled with the first input portion 98 in the left-right direction D3 when the toner container 3M is attached to the attachment portion 58.

In addition, the attachment portion 58 includes a sponge member 582 (an example of the collection member) below the first output joint 61. The sponge member 582 is a porous, flexible resin member having elasticity. The sponge member 582 is formed in a rectangular parallelepiped shape. During the process in which the toner container 3M is removed from the attachment portion 58, the sponge member 582 passes a second opening portion 218 of a film member 217 (see FIG. 14) in the state where the sponge member 582 is contracted while being pressed against a lower surface of the film member 217 of a support plate 102 described below. That is, during the process in which the toner container 3M is removed from the attachment portion 58, the sponge member 582 is slid while pressing the lower surface of the film member 217 (see FIG. 14). In addition, during the process in which the toner container 3M is attached to the attachment portion 58, too, the sponge member 582 is slid while pressing the lower surface of the film member 217 (see FIG. 14). With the configuration where the sponge member 582 is slid on the film member 217 in a contracted state, toner having adhered to the peripheral of the second opening portion 218 is collected by the sponge member 582. It is noted that the sponge member 582 may be replaced with an elastic member that can hold toner in its inside.

As shown in FIG. 5 and FIG. 9, a gear transmission mechanism 103 (an example of the transmission mechanism) is provided in the lid member 76. The gear transmission mechanism 103 is coupled with the rotation shaft 96 of the spiral member 95 and with a rotation shaft member 911 of the stirring member 91 in the state where the lid member 76 closes the opening portions 81 and 82. With this configuration, the rotational driving force transmitted from the first input portion 98 to the spiral member 95 is transmitted to the stirring member 91 by the gear transmission mechanism 103. That is, with the provision of the gear transmission mechanism 103, when the rotational driving force is input to the first input portion 98, the spiral member 95 and the stirring member 91 are rotated interlocking with each other.

The following concretely describes a configuration of the shutter member 101 of the first conveyance portion 92 with reference to FIG. 14.

As shown in FIG. 14, the first conveyance portion 92 includes the support plate 102, as well as the above-described first conveyance guide portion 94 and shutter member 101. The support plate 102 supports, on its upper surface, the shutter member 101 in such a manner that the shutter member 101 can move between the closing position and the opening position (position shown in FIG. 14) in the depth direction D13. The first conveyance guide portion 94 includes a bottom portion 943 and a cylindrical cylinder portion 944, wherein the bottom portion 943 constitutes a lower surface of the first conveyance guide portion 94, and the cylinder portion 944 is integrally formed with the bottom portion 943 so as to be located above the bottom portion 943. The bottom portion 943 is formed in a shape of a plate extending in the depth direction D13. The support plate 102 is provided independently of the first conveyance guide portion 94, and is attached to the bottom portion 943 in such a way as to face the lower surface of the bottom portion 943. It is noted that the toner discharge port 100 is formed in the bottom portion 943 so as to penetrate to an inside of the cylinder portion 944.

The support plate 102 is attached to the bottom portion 943 in a state where a gap 210 is formed between the support plate 102 and the bottom portion 943. In addition, the shutter member 101 is disposed in the gap 210 between the support plate 102 and the bottom portion 943 so as to be movable in the depth direction D13.

In the support plate 102, a first opening portion 211 (an example of the opening portion) having a larger size than the toner discharge port 100 is formed. The first opening portion 211 is formed in the support plate 102 at a position near an end portion 1021 in the first input portion 98 side. In the present embodiment, the first opening portion 211 is located below the toner discharge port 100.

Meanwhile, when the toner discharge port 100 is formed in a shape of being opened downward, the support plate 102 for supporting the shutter member 101 is required in the toner container 3M, and the support plate 102 needs the first opening portion 211 through which to pass the toner discharged from the toner discharge port 100. With this configuration, the toner discharged from the toner discharge port 100 passes through the first opening portion 211 and is supplied to the developing device 33 of the image forming apparatus 10. In this case, the toner adheres to a peripheral edge of the first opening portion 211 when the toner is supplied. In the toner container 3M, when the toner container is removed from the image forming apparatus for replacement, the shutter member 101 moves from the opening position to the closing position. When the shutter member 101 moves to the closing position, the shutter member 101 is interposed between the toner discharge port 100 and the first opening portion 211, and the toner discharge port 100 is closed by the shutter member 101. However, the shutter member 101 is not disposed below the first opening portion 211. As a result, when or after the toner container 3M is removed, the toner adhered to the peripheral edge of the first opening portion 211 may be peeled off and fall into the image forming apparatus 10, or fall from the apparatus to outside and smear other members. The toner container 3M of the present embodiment includes the film member 217 as described below, and this makes it possible to prevent the toner from falling off from the peripheral edge of the toner discharge port 100.

The support plate 102 includes the film member 217. The film member 217 is, for example, a microcell polymer sheet formed from a highly functional urethane foam having a high-density, ultra-fine, and uniform cell structure. The film member 217 is, for example, approximately 0.2 mm to 0.25 mm in thickness. Of course, the film member 217 may be formed from a material other than the microcell polymer sheet.

The film member 217 is attached to the support plate 102 in such a way as to cover the first opening portion 211. Specifically, the film member 217 is stuck to a lower surface of the support plate 102 by adhesive or the like. By this way, the film member 217 is fixed to the support plate 102. The film member 217 has the second opening portion 218 of a square shape at a position corresponding to the toner discharge port 100. The second opening portion 218 is formed in the same size as the toner discharge port 100. That is, the toner discharge port 100 and the second opening portion 218 are disposed so as to face each other in the height direction D11, and when the support plate 102 is viewed from below, the toner discharge port 100 and the second opening portion 218 overlap each other.

In addition, a third opening portion 213 is formed in the shutter member 101. The third opening portion 213 is formed in the same size as the toner discharge port 100 and the second opening portion 218. In the present embodiment, when the shutter member 101 is at the opening position, the third opening portion 213 is located between the toner discharge port 100 and the second opening portion 218. In addition, when the shutter member 101 is at the closing position, the third opening portion 213 moves from the toner discharge port 100 and the second opening portion 218 to a position on the end portion 1021 side (the right side in FIG. 14). By this way, the toner discharge port 100 is closed by the shutter member 101.

In addition, a frame edge portion 214 is integrally formed with a lower surface of the shutter member 101. The frame edge portion 214 projects downward from a peripheral edge portion of the third opening portion 213 to a position lower than the lower surface of the shutter member 101 and surrounds the circumference of the third opening portion 213. When the shutter member 101 is moved in the gap 210 from the opening position to the closing position, a lower end of the frame edge portion 214 slides on an upper surface of the film member 217. In other words, the support plate 102 supports the shutter member 101 such that the lower end of the frame edge portion 214 slides on the upper surface of the film member 217 when the shutter member 101 is moved from the opening position to the closing position.

A seal member 221 is provided in the gap 210 between the bottom portion 943 and the support plate 102. The seal member 221 is formed from, for example, a resin member such as a flexible urethane foam having elasticity. The seal member 221 is provided on the bottom portion 943 at a peripheral edge of the toner discharge port 100. In the present embodiment, the seal member 221 is stuck to the lower surface of the bottom portion 943 by an adhesive or the like in such a way as to surround the circumference of the toner discharge port 100. By this way, the seal member 221 prevents toner from leaking from the toner discharge port 100. In addition, having elasticity as described above, the seal member 221 biases the shutter member 101 downward by the elasticity in the state where the shutter member 101 is disposed between the toner discharge port 100 and the film member 217. As a result, the frame edge portion 214 provided on the shutter member 101 is always pressed against the upper surface of the film member 217 when the shutter member 101 moves between the closing position and the opening position. By this way, no gap is generated between the frame edge portion 214 and the film member 217, and toner leakage from between the frame edge portion 214 and the film member 217 is prevented.

In addition, a sponge member 222 is provided in the gap 210. The sponge member 222 is disposed in a region of the gap 210 on the lid member 76 side. On the lid member 76 side, the gap 210 has a region in which the shutter member 101 is not disposed, and the sponge member 222 is provided in this region. The sponge member 222 is stuck to the lower surface of the bottom portion 943 by an adhesive or the like. The sponge member 222 is larger than the gap 210 in thickness in the height direction, and is disposed in the gap 210 in a contracted state. By this way, in the gap 210, the sponge member 222 stops toner from moving toward the lid member 76 (the left side in FIG. 14).

In addition, a through opening 219 is formed in the lower surface of the support plate 102. The through opening 219 is provided at a position that is separated from the first opening portion 211 toward the lid member 76 in the support plate 102. That is, the through opening 219 is provided on the lower surface of the support plate 102 at a position that is separated from the first opening portion 211 by a predetermined distance in a direction away from the attachment portion 58 (leftward in FIG. 14). The through opening 219 penetrates the support plate 102. In the gap 210, the shutter member 101 is disposed in such a way as to seal an opening of the through opening 219 on the gap 210 side. In the present embodiment, during the process in which the shutter member 101 moves between the closing position and the opening position, the shutter member 101 closes the through opening 219. As described above, the support plate 102 supports the shutter member 101 on its upper surface such that the shutter member 101 can move between the closing position and the opening position. However, when passing the through opening 219, the shutter member 101 does not receive friction from the upper surface of the support plate 102. As a result, compared to a case where the through opening 219 is not provided, the shutter member 101 can move smoothly on the upper surface of the support plate 102.

It is noted that the through opening 219 may be formed at such a position where the sponge member 582 of the attachment portion 58 enters the through opening 219 while the toner container 3M is in the attachment attitude of being completely attached to the attachment portion 58. In this case, the through opening 219 has a role of a retreat port for the sponge member 582 while the toner container 3M is in the attachment attitude. When the sponge member 582 of the attachment portion 58 enters the through opening 219 while the toner container 3M is in the attachment attitude, the sponge member 582 that has been in a contracted state expands as much as the depth of the through opening 219. In the present embodiment, the amount by which the sponge member 582 is contracted when it is pressed against the film member 217 is set for it to be contracted as much as the depth of the through opening 219. By this way, upon entering the through opening 219, the sponge member 582 is restored to the original state.

With the above-described configuration where the film member 217 is provided in the support plate 102, even if toner is adhered to an edge portion of the second opening portion 218 of the film member 217 when toner is supplied, the amount of the adhered toner is very small. As a result, the configuration reduces the possibility that the toner adhered to the edge portion of the second opening portion 218 may fall off and smear other members when the toner container 3M is removed from the attachment portion 58. In addition, as described above, since the sponge member 582 is provided in the attachment portion 58, the small amount of toner that has adhered to the second opening portion 218 is collected by the sponge member 582 in a reliable manner when the toner container 3M is removed from the attachment portion 58.

Furthermore, since the through opening 219 is provided in the support plate 102, the shutter member 101 can move smoothly on the upper surface of the support plate 102. In addition, even if an excessive force is applied to the support plate 102 by an impact received when the toner container 3M is attached to or removed from the attachment portion 58, the support plate 102 can bend in the vicinity of the through opening 219. This prevents the support plate 102 from being damaged or deformed by an excessive force.

In addition, since the sponge member 582 is not always in a contracted state, but is restored to its original state while the toner container 3M is in the attachment attitude of being attached to the attachment portion 58, it is possible to prevent the sponge member 582 from being fixed in a contracted state.

As shown in FIG. 6, the lower storage portion 72 includes a second conveyance portion 105. Specifically, the second conveyance portion 105 for conveying the waste toner discharged from a drum unit 31 for magenta to the inside of the storage space 86 is provided in the storage space 86. The second conveyance portion 105 includes a second conveyance guide portion 107 and a spiral member 108, wherein the second conveyance guide portion 107 is cylindrical, extends outward from a wall surface 791 of the left side of the lower case 79, and includes a toner conveyance path in its inside, and the spiral member 108 (an example of the second rotating member, the rotating member, and the first conveyance member, see FIG. 11) is provided in the inside of the second conveyance guide portion 107. The second conveyance guide portion 107 is integrally formed with the lower case 79.

The spiral member 108 is rotatably provided in the inside of the lower storage portion 72, and as shown in FIG. 11, extends in the depth direction D13 perpendicular to the height direction D11. The spiral member 108 is a conveyance member that conveys the waste toner that has been discharged from the drum unit 31 to the second conveyance guide portion 107, to the storage space 86 through the inside of the second conveyance guide portion 107. In addition, the second conveyance guide portion 107 is a guide member that receives the waste toner from the drum unit 31, and guides the waste toner conveyed by the spiral member 108 to the inside of the storage space 86.

As shown in FIG. 11, the spiral member 108 includes spiral blades 110 around a rotation shaft 109. An end portion 1091 (an example of the second end portion) of the rotation shaft 109 of the spiral member 108 on the lid member 76 side is rotatably supported by a bearing portion 112 (an example of the second bearing portion) that is integrally formed with the inner surface 762 of the lid member 76. In addition, in a state where the spiral member 108 is inserted in the second conveyance guide portion 107, the opposite end of the rotation shaft 109 is rotatably supported by the second conveyance guide portion 107. Specifically, a second input portion 111 (an example of the second drive input portion and the first input joint) is attached to an opposite end portion 1092 of the rotation shaft 109, wherein the second input portion 111 receives a rotational driving force input from outside.

As shown in FIG. 11, the inlet 114 for guiding the waste toner to the inside of the storage space 86 is formed on the upper surface of the second conveyance guide portion 107. In addition, on the upper surface of the second conveyance guide portion 107, a shutter member 115 for opening and closing the inlet 114 is provided. The shutter member 115 is supported by the second conveyance guide portion 107 such that the upper surface of the second conveyance guide portion 107 can be slid in the longitudinal direction (the left-right direction of FIG. 11) of the second conveyance guide portion 107.

In the present embodiment, when the toner container 3M is attached to the attachment portion 58 (see FIG. 4), the shutter member 115 is moved from a closing position of closing the inlet 114, to an opening position of opening the inlet 114.

In addition, the inlet 114 is aligned with the discharge port 431 of the discharge guide portion 43 for positioning, then the inlet 114 is connected to the discharge port 431 so that waste toner can be conveyed from the discharge port 431 to the inlet 114. In addition, the second input portion 111 is coupled with a second output joint 62 (an example of the drive output portion and the first drive coupling portion, see FIG. 13) that is provided in the attachment portion 58, and a rotational driving force output from a drive source such as a motor is transmitted to the second input portion 111. Upon receiving the rotational driving force, the spiral member 108 is rotated, and the waste toner that has been discharged from the discharge port 431 and conveyed into the second conveyance guide portion 107 is conveyed to the storage space 86 through the second conveyance guide portion 107.

As shown in FIG. 13, the second output joint 62 is provided in the attachment portion 58, at a position different from the first output joint 61. The second output joint 62 is a drive output portion configured to output the rotational driving force that is output from a drive source such as a motor provided in the image forming apparatus 10, to the outside. The second output joint 62 is coupled with the second input portion 111 in the left-right direction D3 when the toner container 3M is attached to the attachment portion 58.

As described above, in the present embodiment, the central flange 832 is provided so as to couple the upper case 78 of the upper storage portion 71 with the lower case 79 of the lower storage portion 72. As a result, even if, due to a production error or the like, the first input portion 98 and the second input portion 111 are positionally deviated, or the first output joint 61 and the second output joint 62 are positionally deviated, the toner container 3M can be bent at the vicinity of the gap 88 when the toner container 3M is attached to the attachment portion 58, so that the first input portion 98 is aligned with the first output joint 61, and the second input portion 111 is aligned with the second output joint 62 for positioning. This allows the first input portion 98 to be coupled with the first output joint 61, and the second input portion 111 to be coupled with the second output joint 62, smoothly in a reliable manner. In addition, in a case where the rotational driving force is transmitted in the state where the toner container 3M is attached to the attachment portion 58, even if, due to a positional deviation, a load is applied to the input portions 98 and 111 or the output joints 61 and 62, the load escapes toward the central flange 832 and bends the toner container 3M at the vicinity of the gap 88. With this configuration, it is possible to distribute the load of the input portions 98 and 111 or the output joints 61 and 62 and prevent the input portions 98 and 111 or the output joints 61 and 62 from being damaged.

As shown in FIG. 8, the first conveyance portion 92 and the second conveyance portion 105 are separated from each other in the width direction D12. Specifically, the first conveyance portion 92 is provided on the wall surface 781 of the upper storage portion 71 at a position close to a side portion on one side (the front side) in the width direction D12. In addition, the second conveyance portion 105 is provided on the wall surface 791 of the lower storage portion 72 at a position close to a side portion on the opposite side (the rear side) in the width direction D12.

As shown in FIG. 7 and FIG. 9, the toner container 3M includes a gripping portion 122 having a concave portion 123. The gripping portion 122 is a portion that is gripped by the user when the user carries or performs a replacement of the toner container 3M. In the present embodiment, the concave portion 123 is formed in one side of the container main body 75 in the width direction D12. More specifically, the concave portion 123 is formed between the upper storage portion 71 and the lower storage portion 72 in a side portion on the front side in the attachment attitude of the toner container 3M attached to the attachment portion 58. The concave portion 123 passes through the toner container 3M in the depth direction D13, and when the toner container 3M is viewed from the lid member 76 side, the concave portion 123 is rectangular. With the formation of the concave portion 123, the toner container 3M has the gripping portion 122 that is a narrowed, constricted portion. Since, the gripping portion 122 is formed in a constricted shape so as to be easily held by the user, the user can easily place his/her fingers on the gripping portion 122, easily carry the toner container 3M, and easily perform the replacement work. It is noted that since the lid member 76 is formed in the shape that matches the shape of the container main body 75, the lid member 76 also has a constricted portion in correspondence with the gripping portion 122.

It is noted that as shown in FIG. 5, in the toner container 3K, the concave portion 123 is formed in each of the side portions on opposite sides in the width direction D12.

As shown in FIG. 7, the concave portion 123 is provided in an upper portion of the lower storage portion 72. As a result, under the constraint that the toner container 3M cannot be increased in size, the presence of the concave portion 123 reduces the capacity of the storage space 86 of the lower storage portion 72. However, since the lower storage portion 72 is configured to store waste toner, the upper space of the storage space 86 is never filled until the storage space 86 is filled with the waste toner. For this reason, the concave portion 123 is preferably formed in the lower storage portion 72. The upper storage portion 71 is configured to store unused toner. As a result, if the concave portion 123 is formed in the upper storage portion 71, the storage space 85 of the upper storage portion 71 cannot secure a prescribed capacity required to store the unused toner. Thus it is not preferable to form the concave portion 123 in the upper storage portion 71.

In addition, the concave portion 123 is formed in proximity to the first conveyance portion 92, more specifically, directly under the shutter member 101 of the first conveyance portion 92. When the toner container 3M is attached to or detached from the attachment portion 58, the shutter member 101 is opened or closed, and the opening or closing of the shutter member 101 generates a sliding resistance. When performing a replacement work of the toner container 3M, the user feels the sliding resistance as a load. However, the concave portion 123 is provided directly under the shutter member 101. Thus, when performing a replacement work of replacing the toner container 3M by gripping the gripping portion 122, the user can easily apply a force to the gripping portion 122, and can directly transmit a force to the shutter member 101. With this configuration, the workability during the replacement work is improved.

As shown in FIG. 5 and FIG. 9, the toner container 3M includes an identification label 126 that indicates the type of the toner container 3M (for example, the color of the toner, model number or the like). The identification label 126 is a sheet-like member whose rear side is coated with an adhesive such as paste, and characters and/or symbols indicating the type are written on the front side thereof. The identification label 126 is stuck to the surface of the lid member 76. Specifically, the identification label 126 is stuck to a region in an outer surface of the lid member 76 that corresponds to the gripping portion 122. According to conventional toner containers, the container main body 75 or the lid member 76 of the toner container 3M is colored to the color of the toner stored therein so that the type thereof can be identified. On the other hand, in the present embodiment, the identification label 126 is used to make the toner container 3 identifiable. This makes it possible to unify the toner containers 3 for color printing.

As shown in FIG. 12, an IC substrate 64 is mounted on an upper portion of the wall surface 781 of the upper case 78, wherein the IC substrate 64 includes a plurality of contact terminals 67. The upper portion of the wall surface 781 includes a concave recess portion 783 that is recessed from the wall surface 781 by one stage. Specifically, the concave recess portion 783 is formed on the wall surface 781 to continue to the upper end of the wall surface 781. The concave recess portion 783 is lower than the wall surface 781 by one stage. The concave recess portion 783 is formed to extend over the whole region of the upper portion of the wall surface 781 in the width direction D12. The IC substrate 64 is disposed on the concave recess portion 783. More specifically, the IC substrate 64 is disposed at the center of the concave recess portion 783 in the width direction D12.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner container comprising:

an elongated container main body configured to store toner in an inside thereof;

a toner discharge port formed in a bottom surface of the container main body that is disposed such that a longitudinal direction thereof matches an up-down direction, and configured to discharge the toner stored in the container main body to outside;

a first rotation member rotatably provided in the container main body, extending in a depth direction of the container main body, and configured to convey the toner stored in the container main body toward the toner discharge port, the depth direction being perpendicular to the longitudinal direction of the container main body;

a support plate provided in the container main body and disposed in such a way as to face the bottom surface; and an opening and closing member provided in a gap formed between the bottom surface and the support plate and supported by the support plate in such a way as to be able to move between a closing position of closing the toner discharge port and an opening position of opening the toner discharge port, wherein the support plate includes:

a first opening portion formed at a position corresponding to the toner discharge port and larger than the toner discharge port in size; and a film member attached to the support plate in such a way as to cover the first opening portion, and including a second opening portion formed at the position corresponding to the toner discharge port, the second opening portion is formed in a same size as the toner discharge port, the opening and closing member includes:

a third opening portion formed in the same size as the toner discharge port and the second opening portion, and disposed between the toner discharge port and the second opening portion when the opening and closing member is at the opening position; and a frame edge portion projecting from a peripheral edge portion of the third opening portion toward the support plate, and the support plate supports the opening and closing member such that a projection end of the frame edge portion slides on a surface of the film member as the opening and closing member moves from the opening position to the closing position.

2. A toner container comprising:

an elongated container main body configured to store toner in an inside thereof;

a toner discharge port formed in a bottom surface of the container main body that is disposed such that a longitudinal direction thereof matches an up-down direction, and configured to discharge the toner stored in the container main body to outside;

a first rotation member rotatably provided in the container main body, extending in a depth direction of the container main body, and configured to convey the toner stored in the container main body toward the toner discharge port, the depth direction being perpendicular to the longitudinal direction of the container main body;

a support plate provided in the container main body and disposed in such a way as to face the bottom surface; and an opening and closing member provided in a gap formed between the bottom surface and the support plate and supported by the support plate in such a way as to be able to move between a closing position of closing the toner discharge port and an opening position of opening the toner discharge port, wherein the support plate includes:

a first opening portion formed at a position corresponding to the toner discharge port and larger than the toner discharge port in size; and a film member attached to the support plate in such a way as to cover the first opening portion, and including a second opening portion formed at the position corresponding to the toner discharge port, the toner container further comprises a seal member having elasticity and provided at a peripheral edge of the toner discharge port, and the support plate supports the opening and closing member in a state where the opening and closing member is biased toward the support plate by the elasticity of the seal member.

3. A toner container comprising:

an elongated container main body configured to store toner in an inside thereof;

a toner discharge port formed in a bottom surface of the container main body that is disposed such that a longitudinal direction thereof matches an up-down direction, and configured to discharge the toner stored in the container main body to outside;

a first rotation member rotatably provided in the container main body, extending in a depth direction of the container main body, and configured to convey the toner stored in the container main body toward the toner discharge port, the depth direction being perpendicular to the longitudinal direction of the container main body;

a support plate provided in the container main body and disposed in such a way as to face the bottom surface; and an opening and closing member provided in a gap formed between the bottom surface and the support plate and supported by the support plate in such a way as to be able to move between a closing position of closing the toner discharge port and an opening position of opening the toner discharge port, wherein the support plate includes:

a first opening portion formed at a position corresponding to the toner discharge port and larger than the toner discharge port in size; and a film member attached to the support plate in such a way as to cover the first opening portion, and including a second opening portion formed at the position corresponding to the toner discharge port, the toner container is attached to an attachment portion included in an image forming apparatus such that the longitudinal direction matches the up-down direction, the container main body includes a cylindrical first guide portion extending outward from a facing surface that faces the attachment portion while the toner container is in an attachment attitude of being attached to the attachment portion, the first rotation member extends from the inside of the container main body to an inside of the first guide portion, the toner discharge port is formed in a lower surface of the first guide portion, and the support plate is attached to the first guide portion in such a way as to face the lower surface of the first guide portion.

4. The toner container according to claim 3, wherein the container main body includes:

a first toner storage portion configured to store unused toner in an inside thereof and provided in an upper part of the container main body while the toner container is in the attachment attitude; and a second toner storage portion configured to store, in an inside thereof, used toner collected from the image forming apparatus, and is provided in a lower part of the container main body below the first toner storage portion while the toner container is in the attachment attitude, the toner container further comprises:

a second rotation member rotatably provided in the second toner storage portion, extending in the depth direction, and configured to convey the used toner to the inside of the second toner storage portion by being rotated, and the first rotation member is provided in the first toner storage portion and configured to convey the unused toner toward the toner discharge port by being rotated.

* * * * *